US008800319B2

(12) United States Patent
Takayama et al.

(10) Patent No.: US 8,800,319 B2
(45) Date of Patent: Aug. 12, 2014

(54) REFRIGERATING CYCLE DEVICE USED IN AN AIR CONDITIONING APPARATUS, A REFRIGERATING DEVICE AND THE LIKE

(75) Inventors: Keisuke Takayama, Tokyo (JP); Yusuke Shimazu, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 361 days.

(21) Appl. No.: 13/318,749

(22) PCT Filed: May 29, 2009

(86) PCT No.: PCT/JP2009/002377

§ 371 (c)(1),
(2), (4) Date: Nov. 3, 2011

(87) PCT Pub. No.: WO2010/137078

PCT Pub. Date: Dec. 2, 2010

(65) Prior Publication Data

US 2012/0060551 A1 Mar. 15, 2012

(51) Int. Cl.

| | |
|---|---|
| ***F25B 41/00*** | (2006.01) |
| ***F25B 17/02*** | (2006.01) |
| ***F25B 40/00*** | (2006.01) |
| *F25B 25/00* | (2006.01) |
| *F25B 40/02* | (2006.01) |
| *B60H 1/00* | (2006.01) |

(52) U.S. Cl.

CPC ..... *F25B 40/00* (2013.01); *F25B 2313/0233* (2013.01); *F25B 25/005* (2013.01); *F25B 2313/006* (2013.01); *F25B 40/02* (2013.01); *B60H 2001/00928* (2013.01); *F25B 2400/05* (2013.01)

USPC ..... 62/513; 62/185

(58) Field of Classification Search

CPC ..... F25B 40/00; F25B 40/02; F25B 25/005; F25B 2400/05; F25B 2313/0233; F25B 2313/006; B60H 2001/00928

USPC ..... 62/18

See application file for complete search history.

(56) References Cited

U.S. PATENT DOCUMENTS 5,044,172 A * 9/1991 Inoue et al. ..... 62/335

(Continued)

FOREIGN PATENT DOCUMENTS

CN 1603717 A 4/2005

(Continued)

OTHER PUBLICATIONS

Chinese Office Action dated Jun. 3, 2013, issued issued by the Chinese Patent Office in corresponding Chinese Patent Application No. 200980159565.1, and partial English language translation of Office Action. (6 pages).

(Continued)

*Primary Examiner* — Allen Flanigan
*Assistant Examiner* — Filip Zec
(74) *Attorney, Agent, or Firm* — Buchanan Ingersoll & Rooney PC

(57) ABSTRACT

Energy saving of a refrigerating cycle device is achieved by equalizing heat-medium inlet temperatures of a plurality of use-side heat exchangers. There are provided with a plurality of use-side heat exchangers, inter-heat-medium heat exchangers, a channel that connects the inter-heat-medium heat exchanger and the use-side heat exchanger, a heat-medium circulation circuit having heat-medium channel switching devices that switch between a first heat-medium channel, which connects the inter-heat-medium heat exchanger and the use-side heat exchanger, and a second heat-medium channel, which connects the inter-heat-medium heat exchanger and the use-side heat exchanger, and a heat source unit that heats or cools the heat medium with the inter-heat-medium heat exchangers, in which an auxiliary heat exchanger that performs heat exchange between the heat mediums flowing out from the inter-heat-medium heat exchangers is disposed so as to equalize the heat-medium temperatures flowing into the use-side heat exchangers to realize energy saving of the refrigerating cycle device.

7 Claims, 7 Drawing Sheets

(56) References Cited

U.S. PATENT DOCUMENTS

| | | | |
|---|---|---|---|
| 2005/0087334 | A1 | 4/2005 | Yamasaki |
| 2005/0178141 | A1 | 8/2005 | Matsumoto et al. |

FOREIGN PATENT DOCUMENTS

| | | | | | |
|---|---|---|---|---|---|
| CN | 1654904 | A | | 8/2005 | |
| JP | 62-084241 | A | | 4/1987 | |
| JP | 64-063763 | A | | 3/1989 | |
| JP | 03-017475 | A | | 1/1991 | |
| JP | 03-084370 | A | | 4/1991 | |
| JP | 6-082110 | A | | 3/1994 | |
| JP | 06-337138 | A | | 12/1994 | |
| JP | 10062020 | A | * | 3/1998 | ..... F25B 1/00 |
| JP | 10-267494 | A | | 10/1998 | |
| JP | 2003343936 | A | * | 12/2003 | ..... F25B 13/00 |
| JP | 2004-053069 | A | | 2/2004 | |

OTHER PUBLICATIONS

International Search Report (PCT/ISA/210) issued on Jun. 30, 2009, by Japanese Patent Office as the International Searching Authority for International Application No. PCT/JP2009/002377.

* cited by examiner

REFRIGERATING CYCLE DEVICE USED IN AN AIR CONDITIONING APPARATUS, A REFRIGERATING DEVICE AND THE LIKE

TECHNICAL FIELD

The present invention relates to a refrigerating cycle device used in an air conditioning apparatus, a refrigerating device and the like such as a multiple-unit air conditioning apparatus for a building and an air conditioner.

BACKGROUND ART

Some prior-art refrigerating cycle devices provided with a plurality of indoor units (use-side heat exchangers) used as a multiple-unit air conditioning apparatus for a building or the like heat or cool a heat medium in the secondary side in an inter-heat-medium heat exchanger of a heat source device and distribute the heat medium to each use-side heat exchangers. As for such a refrigerating cycle device, with indoor units that can each perform a cooling operation and a heating operation individually, a multiple-chamber cooling/heating device provided with a heat-source cycle having a first auxiliary heat exchanger for heating and a first auxiliary heat exchanger for cooling, a use-side refrigerant cycle for heating, and a use-side refrigerant cycle for cooling has been proposed, for example (See Patent Literature 1, for example). When all the use-side heat exchangers, which are secondary cycles, are performing a cooling operation, a part of the refrigerant discharged from a refrigerant conveying device for cooling is made to flow through a third auxiliary heat exchanger for cooling, and when in the use-side refrigerant cycle for heating, the refrigerant discharged from a refrigerant conveying device for heating is made to flow through a fourth auxiliary heat exchanger for cooling, for heat exchange with each other so as to perform the cooling operation in the use-side refrigerant cycle for heating, too.

Also, as another example, a multiple-room heating device provided with a heat source cycle having a first auxiliary heat exchanger and a second auxiliary heat exchanger, a first use-side refrigerant cycle and a second use-side refrigerant cycle, which are secondary cycles, has been proposed (See Patent Literature 2, for example). When all the use-side heat exchangers are performing a cooling operation, a heat-source side refrigerant is evaporated both by the first auxiliary heat exchanger and the second auxiliary heat exchanger, and both the first use-side refrigerant cycle and the second use-side refrigerant cycle are performing a cooling operation. Also, when all the use-side heat exchangers are performing a heating operation, both the two auxiliary heat exchangers are condensing the heat-source side refrigerant.

CITATION LIST

Patent Literature

Patent Literature 1: Japanese Unexamined Patent Application Publication No. 6-82110 (FIG. 1 and the like)

Patent Literature 2: Japanese Unexamined Patent Application Publication No. 6-337138 (FIG. 1 and the like)

SUMMARY OF INVENTION

Technical Problem

However, with the conventional refrigerating cycle device illustrated in Patent Literature 1, only one of the auxiliary heat exchangers that perform heat exchange between the primary-side refrigerant and the secondary-side refrigerant is used when performing a cooling only operation, and thus, the amount of heat exchanged between the primary-side refrigerant and the secondary-side refrigerant cannot be increased. If the amount of heat exchanged is to be increased in order to increase cooling capacity, for example, an output of the heat source device needs to be increased by increasing the speed of a compressor in the heat source device, and energy cannot be saved, which is a problem.

Also, with the conventional refrigerating cycle device shown in Patent Literature 2, if all the use-side heat exchangers are performing a heating operation, the heat-source-side refrigerant discharged from the compressor is condensed by the second auxiliary heat exchanger and then, condensed by the first auxiliary heat exchanger. As a result, discharged gas from the compressor at a high temperature flows into the second auxiliary heat exchanger, but since the condensed heat-source-side refrigerant flows into the first auxiliary heat exchanger, the temperature of the refrigerant becomes lower than an inlet temperature of the second auxiliary heat exchanger. Thus, the temperatures of each use-side refrigerants discharged from the first refrigerant conveying device and the second refrigerant conveying device, supplied to a plurality of use-side heat exchangers are different, and a problem is caused in that large difference of temperature between each refrigerant inlet of the plurality of indoor heat exchangers. In order to raise the use-side refrigerant temperature in the first auxiliary heat exchanger, an output of the heat source device needs to be increased by increasing the speed of the compressor in the heat source device, whereby the use-side refrigerant is excessively heated in the second auxiliary heat exchanger. As a result, energy saving cannot be accomplished and excessive heating undermines comfort of users, which is a problem. Thus, as in Patent Literature 2, the two indoor heat exchangers connected to the first use-side refrigerant cycle and the second use-side refrigerant cycle need to be contained in one heating/cooling indoor unit, which causes a problem of size increase of the indoor unit.

Moreover, when the first use-side refrigerant and the second use-side refrigerant are made to perform heat exchange in order to solve the difference of the use-side refrigerant temperatures, if the use-side refrigerant circuit is constituted as in the example described in Patent Literature 1, concern of the following problems rises. For example, since only a part of the refrigerant discharged from the refrigerant conveying device contributes to heat exchange, the constitution is not effective in making the difference of the plurality of use-side refrigerant temperatures small. Moreover, in the use-side refrigerant circuit on the side where a part of the use-side refrigerant is bypassed in order to perform heat exchange, the heat-exchanged use-side refrigerant does not circulate through the indoor unit but returns to the auxiliary heat exchanger. At this time, a high-temperature use-side refrigerant returns during heating and a low-temperature use-side refrigerant returns during cooling, which causes a problem of lowered heat-exchange efficiency of the auxiliary heat exchanger.

The present invention was made to solve the above-described problems and an object thereof is to provide an efficient refrigerating cycle device with less waste of energy by performing heat exchange between the heat mediums flowing out of the plurality of inter-heat-medium heat exchangers so as to equalize the outlet temperatures of the heat mediums when the heat mediums are heated or cooled in the plurality of inter-heat-medium heat exchangers and made to flow through the plurality of indoor units, which are a plurality of use-side heat exchangers. Also, another object is to obtain a small-sized air conditioning apparatus in which load adjustment of a plurality of indoor unit is easy.

Solution to Problem

A refrigerating cycle device according to the present invention is provided with:

a plurality of use-side heat exchangers;

a first inter-heat-medium heat exchanger having one port connected to each heat-medium inlet of the use-side heat exchangers by a pipeline and the other port connected to each heat-medium outlet of the use-side heat exchangers;

a second inter-heat-medium heat exchanger having one port connected to each heat-medium inlet of the use-side heat exchangers by a pipeline and the other port connected to each heat-medium outlet of the use-side heat exchangers;

a plurality of first heat-medium channel switching devices, each of which is disposed on the heat-medium inflow side of each of the use-side heat exchangers, switches between a first inflow-side channel, which connects the first inter-heat-medium heat exchanger and the heat-medium inlets of the use-side heat exchangers, and a second inflow-side channel, which connects the second inter-heat-medium heat exchanger and the heat-medium inlets of the use-side heat exchangers;

a plurality of second heat-medium channel switching devices, each of which is disposed on the heat-medium outflow side of each of the use-side heat exchangers, switches between a first outflow-side channel, which connects the first inter-heat-medium heat exchanger and the heat-medium outlets of the use-side heat exchangers, and a second outflow-side channel, which connects the second inter-heat-medium heat exchanger and the heat-medium outlets of the use-side heat exchangers;

a first heat-medium feeding device that allows a heat medium to flow through the first inflow-side channel that connects the first inter-heat-medium heat exchanger and the use-side heat exchangers;

a second heat-medium feeding device that allows a heat medium to flow through the second inflow-side channel that connects the second inter-heat-medium heat exchanger and the use-side heat exchangers;

a plurality of heat-medium flow-rate regulation units, which are disposed between the heat-medium outlets of the first heat-medium channel switching devices and the heat-medium inlets of the second heat-medium channel switching devices, controlling flow rates of the heat mediums flowing through each of the use-side heat exchangers;

a heat source device that is connected to the first inter-heat-medium heat exchanger and the second inter-heat-medium heat exchanger and supplies heating energy or cooling energy to the first inter-heat-medium heat exchanger and the second inter-heat-medium heat exchanger so as to heat or cool the heat medium flowing from the first inter-heat-medium heat exchanger and the second inter-heat-medium heat exchanger to the use-side heat exchanger;

an auxiliary heat exchanger having a first heat-medium inlet which is connected to the first inter-heat-medium heat exchanger by a pipeline and which the heat medium is allowed to flow into and a second heat-medium inlet which is connected to the second inter-heat-medium heat exchanger by a pipeline and which the heat medium is allowed to flow into, having a first heat-medium outlet and a second heat-medium outlet which allow the heat medium having flowed in from the first heat-medium inlet and the second heat-medium inlet to flow out to the use-side heat exchanger through a plurality of the first heat-medium channel switching devices, and performing heat exchange between a first heat medium flowing from the first heat-medium inlet to the first heat-medium outlet and a second heat medium flowing from the second heat-medium inlet to the second heat-medium outlet through a heat transfer material or performing heat exchange by mixing the first heat medium flowing in from the first heat-medium inlet and the second heat medium flowing in from the second heat-medium inlet and allowing the mixture to flow out of the first heat-medium outlet and the second heat-medium outlet; and a circulation circuit that connects a bypass pipeline that bypasses the auxiliary heat exchanger and the opening/closing valve disposed in the bypass pipeline to the heat-medium outlet of either the first inter-heat-medium heat exchanger or the second inter-heat-medium heat exchanger that the heat medium flows out from.

Advantageous Effects of Invention

The present invention realizes heat exchange of a heat medium flowing out of the first inter-heat-medium heat exchanger and the heat medium flowing out of the second inter-heat-medium heat exchanger by an auxiliary heat exchanger and can substantially equalize the temperatures of the heat mediums flowing into the plurality of use-side heat exchangers even if there is a temperature difference in the heat mediums flowing out of the two inter-heat-medium heat exchangers. Therefore, a refrigerating cycle device that is efficient and can be easily used without waste of energy can be obtained. Also, an air conditioning apparatus in which a load of an indoor unit can be adjusted easily and user comfort can be easily obtained can be obtained.

DESCRIPTION OF EMBODIMENTS

Embodiment 1

Figure 1:
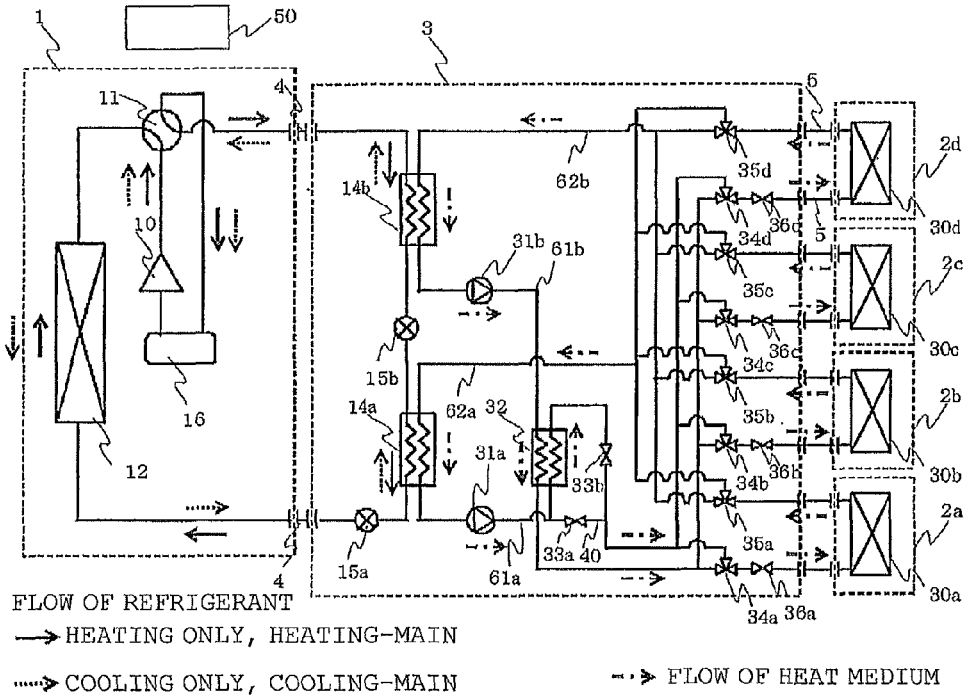
FIG. 1 is an entire circuit diagram according to Embodiment 1 of the present invention.

FIG. 1 is a system circuit diagram of a refrigerating cycle device according to Embodiment 1 of the present invention. The refrigerating cycle device of Embodiment 1 constitute a refrigerating cycle circuit constituted by a compressor 10, a four-way valve 11, which is a refrigerant channel switching device, a heat-source-side heat exchanger 12, inter-heat-medium heat exchangers 14*a* and 14*b*, expansion devices 15*a* and 15*b* such as electronic expansion valves and the like, and an accumulator 16 connected by a pipeline. Here, the inter-heat-medium heat exchanger 14*a* corresponds to a first inter-heat-medium heat exchanger. The inter-heat-medium heat exchanger 14*b* corresponds to a second inter-heat-medium heat exchanger.

Also, a heat-medium circulation circuit is constituted by the inter-heat-medium heat exchangers 14*a* and 14*b*, use-side heat exchangers 30*a*, 30*b*, 30*c*, and 30*d*, pumps 31*a* and 31*b*, which are heat-medium feeding devices, heat-medium channel switching devices 34*a*, 34*b*, 34*c*, 34*d*, 35*a*, 35*b*, 35*c*, and 35*d*, and heat-medium flow-rate regulating devices 36*a*, 36*b*, 36*c*, and 36*d* are connected by a pipeline. Here, the pump 31*a* corresponds to a first heat-medium feeding device. The pump 31*b* corresponds to a second heat-medium feeding device. The heat-medium channel switching devices 34*a*, 34*b*, 34*c*, and 34*d* correspond to first heat-medium channel switching devices. The heat-medium channel switching devices 35*a*, 35*b*, 35*c*, and 35*d* correspond to second heat-medium channel switching devices. The heat-medium flow-rate regulating devices 36*a*, 36*b*, 36*c*, and 36*d* correspond to a heat-medium flow-rate regulation unit. In Embodiment 1, the number of indoor units 2 (use-side heat exchangers 30) is four, but the number of the indoor units 2 (the use-side heat exchanges 30) is arbitrary.

In this embodiment, the compressor 10, the four-way valve 11, the heat-source-side heat exchanger 12 and the accumulator 16 are contained in a heat source unit 1 (outdoor unit). Also, the heat source unit 1 contains a controller 50 that supervises control of the entire refrigerating cycle device. The use-side heat exchangers 30*a*, 30*b*, 30*c*, and 30*d* are each contained in the indoor units 2*a*, 2*b*, 2*c*, and 2*d*, respectively. The inter-heat-medium heat exchangers 14*a* and 14*b* and the expansion devices 15*a* and 15*b* are contained in a heat-medium converter 3 (branch unit), which is also a heat-medium branch unit. The heat-medium channel switching devices 34*a*, 34*b*, 34*c*, 34*d*, 35*a*, 35*b*, 35*c*, and 35*d* and the heat-medium flow-rate regulating devices 36*a*, 36*b*, 36*c*, and 36*d* are also contained in the heat-medium converter 3.

Also, the heat source unit 1 and the heat-medium converter 3 are connected by a refrigerant pipeline 4. Also, the heat-medium converter 3 and each of the indoor units 2*a*, 2*b*, 2*c*, and 2*d* (each of the use-side heat exchangers 30*a*, 30*b*, 30*c*, and 30*d*) are connected by a heat-medium pipeline 5 through which a safe heat medium such as water, anti-freezing fluid and the like flows. That is, the heat-medium converter 3 and each of the indoor units 2*a*, 2*b*, 2*c*, and 2*d* (each of the use-side heat exchangers 30*a*, 30*b*, 30*c*, and 30*d*) are connected by one heat-medium path.

The compressor 10 pressurizes and discharges (feeds out) a sucked-in refrigerant. Also, the four-way valve 11, which becomes a refrigerant channel switching device, switches a valve corresponding to an operation mode concerning the cooling/heating on the basis of an instruction of the controller 50 so as to which the path of the refrigerant. In Embodiment 1, a circulation path is made to be switched in a cooling only operation (an operation in which all the operating indoor units 2 are performing cooling (including dehumidifying. The same applies in the following)), a cooling-main operation (an operation in which cooling is mainly performed if there are indoor units 2 performing cooling and heating at the same time), a heating only operation (an operation in which all the performing indoor units 2 are performing heating), and a heating-main operation (an operation in which heating is mainly performed if there are indoor units 2 performing heating and cooling at the same time).

The heat-source-side heat exchanger 12 has a heat transfer pipe through which the refrigerant flows and a fin (not shown) that enlarges a heat transfer area between the refrigerant flowing through the heat transfer pipe and the outside air and performs heat exchange between the refrigerant and the air (outside air), for example. The heat-source-side heat exchanger 12 functions as an evaporator during the heating only operation and the heating-main operation and evaporates and gasifies the refrigerant, for example. On the other hand, the heat-source-side heat exchanger 12 functions as a condenser or a gas cooler (hereinafter referred to as a condenser) during the cooling only operation and the cooling-main operation. In some cases, the heat-source-side heat exchanger 12 does not fully gasify or liquefy but brings the refrigerant into a two-phase mixed state of a liquid and gas (gas-liquid two-phase refrigerant).

The inter-heat-medium heat exchangers 14*a* and 14*b* has a heat transfer portion through which the refrigerant passes and a heat transfer portion through which the heat medium passes and performs heat exchange between the refrigerant and the heat medium. In Embodiment 1, the inter-heat-medium heat exchanger 14*a* functions as an evaporator in the cooling only operation and the heating-main operation and allows the refrigerant to absorb heat and the heat medium to be cooled. On the other hand, the inter-heat-medium heat exchanger 14*a* functions as a condenser in the heating only operation and the cooling-main operation and allows the refrigerant to radiate heat and the heat medium to be heated. The inter-heat-medium heat exchanger 14*b* functions as an evaporator in the cooling only operation and the cooling-main operation and functions as a condenser in the heating only operation and the heating-main operation. The expansion devices 15*a* and 15*b* such as electronic expansion valves and the like decompress the refrigerant by regulating the refrigerant flow rate, for example. The accumulator 16 serves to store excess refrigerant in the refrigerating cycle circuit and to prevent breakage of the compressor 10 caused by return of a large amount of refrigerant liquid to the compressor 10.

The pumps 31*a* and 31*b*, which are the heat-medium feeding devices, pressurize the heat medium for circulation. Here, with regard to the pumps 31*a* and 31*b*, a flow rate at which the heat medium is fed out (discharge flow rate) can be changed by changing a rotation speed of a built-in motor (not shown) within a certain range. Also, each of the use-side heat exchangers 30*a*, 30*b*, 30*c*, and 30*d* perform heat exchange between the heat medium and the air in the air space of the air conditioning apparatus in each of the indoor units 2*a*, 2*b*, 2*c*, and 2*d* so as to heat or cool the air in the air space of the air conditioning apparatus.

The heat-medium channel switching devices 34*a*, 34*b*, 34*c*, and 34*d*, which are three-way switching valves or the like, for example, are connected to the heat-medium inlets of the use-side heat exchangers 30*a*, 30*b*, 30*c*, and 30*d*, respectively, by a pipeline and perform switching of the channels on the inlet sides (heat-medium inflow sides) of the use-side heat exchangers 30*a*, 30*b*, 30*c*, and 30*d*. Also, the heat-medium channel switching devices 35, 35*b*, 35*c*, and 35*d*, which are three-way switching valves or the like, for example, are connected to the heat-medium outflow sides of the use-side heat exchangers 30*a*, 30*b*, 30*c*, and 30*d*, respectively, by a pipeline and perform switching of the channels on the outlet sides (heat-medium outflow sides) of the use-side heat exchangers 30*a*, 30*b*, 30*c*, and 30*d*. These switching devices perform switching so that either one of the heat medium flowing through the inter-heat-medium heat exchanger 14*a* or the heat medium flowing through the inter-heat-medium heat exchanger 14*b* passes through the use-side heat exchangers 30*a*, 30*b*, 30*c*, and 30*d*.

Moreover, the heat-medium flow-rate regulating devices 36*a*, 36*b*, 36*c* and 36*d*, which are two-way flow-rate regulator valves, for example, regulate flow rates of the heat mediums flowing into the use-side heat exchangers 30*a*, 30*b*, 30*c*, and 30*d*, respectively.

<Operation Mode>

Subsequently, an operation of the refrigerating cycle device in each operation mode will be described on the basis of flows of the refrigerant and the heat medium. Now, the magnitude of the pressure in the refrigerating cycle circuit and the like is not determined in relation to a baseline pressure but is expressed as a high pressure and a low pressure in a relative manner in the course of compression of the compressor 10, control of refrigerant flow-rate of the expansion devices 15*a* and 15*b* and the like. The same is applied to the temperature.

(Cooling Only Operation)

First, the flow of the refrigerant in the refrigerating cycle circuit will be described. In the heat source unit 1, the refrigerant sucked into the compressor 10 is compressed and discharged as a high-pressure gas refrigerant. The refrigerant coming out of the compressor 10 flows into the heat-source-side heat exchanger 12 that functions as a condenser via the four-way valve 11. The high-pressure gas refrigerant is condensed by heat exchange with the outside air while passing through the heat-source-side heat exchanger 12, flows out as a high-pressure liquid refrigerant and flows into the heat-medium converter 3 through the refrigerant pipeline 4.

The refrigerant having flowed into the heat-medium converter 3 is expanded by adjusting the opening degree of the expansion device 15*a*, and a low temperature and low pressure gas-liquid two-phase refrigerant flows into the inter-heat-medium heat exchanger 14*a*. Since the inter-heat-medium heat exchanger 14*a* functions as an evaporator for the refrigerant, the refrigerant passing through the inter-heat-medium heat exchanger 14*a* cools the heat medium, which is the target of the heat exchange (absorbs heat from the heat medium). In the inter-heat-medium heat exchanger 14*a*, the refrigerant is not fully vaporized but flows out, as it is, as the gas-liquid two-phase refrigerant. At this time, the expansion device 15*b* is kept fully open so that pressure loss is not caused.

The low temperature and low pressure gas-liquid two-phase refrigerant further flows into the inter-heat-medium heat exchanger 14*b*. As described above, the gas-liquid two-phase refrigerant cools the heat medium, becomes a gas refrigerant in the inter-heat-medium heat exchanger 14*b* and flows out. The gas refrigerant having flowed out passes through the refrigerant pipeline 4 and flows out of the heat-medium converter 3.

The refrigerant having flowed into the heat source unit 1 is sucked into the compressor 10 again via the four-way valve 11 and the accumulator 16.

Subsequently, the flow of the heat medium in the heat-medium circulation circuit will be described. The heat medium is cooled by heat exchange with the refrigerant in the inter-heat-medium heat exchangers 14*a* and 14*b*. The heat medium having been cooled in the inter-heat-medium heat exchanger 14*a* is sucked by the pump 31*a* and fed out to a first heat-medium channel 61*a*. Also, the heat medium having been cooled in the inter-heat-medium heat exchanger 14*b* is sucked by the pump 31*b* and fed out to a second heat-medium channel 61*b*. The heat medium having been fed out to the first heat-medium channel 61*a* flows into one of inlets of an auxiliary heat exchanger 32. The heat medium having been fed out to the second heat-medium channel 61*b* flows into the other inlet of the auxiliary heat exchanger 32. Detailed effects of the auxiliary heat exchanger 32 will be described later. At this time, an opening/closing device 33*a* is closed, while an opening/closing device 33*b* is opened.

The heat mediums in the first heat-medium channel 61*a* and the second heat-medium channel 61*b* have their channels switched by the heat-medium channel switching devices 34*a*, 34*b*, 34*c*, and 34*d* and flow into the use-side heat exchangers 30*a*, 30*b*, 30*c*, and 30*d*. Here, the channels of the heat-medium channel switching devices 34*a*, 34*b*, 34*c*, and 34*d* are configured such that the heat medium in the first heat-medium channel 61*a* flows into the use-side heat exchangers 30*a* and 30*b* and the heat medium in the second heat-medium channel 61*b* flows into the use-side heat exchangers 30*c* and 30*d*, for example. At this time, it is only necessary that the cooling capacity obtained by totaling capacities of the indoor units 2*a* and 2*b* cooled by the heat medium of the first heat-medium channel 61*a* and the cooling capacity obtained by totaling capacities of the indoor units 2*c* and 2*d* cooled by the heat medium of the second heat-medium channel 61*b* constitute approximately half. The cooling capacity of the indoor units 2*a*, 2*b*, 2*c*, and 2*d* can be determined by the controller 50, for example. In the above case, the heat-medium channel switching devices 34*a* and 34*b* are configured such that the heat medium of the first heat-medium channel 61*a* passes through them. The heat-medium channel switching devices 34*a* and 34*d* are configured such that the heat medium of the second heat medium channel 61*b* passes through them.

The heat medium having passed through the heat-medium channel switching devices 34*a*, 34*b*, 34*c*, and 34*d* have their flow rates flowing into the use-side heat exchangers 30*a*, 30*b*, 30*c*, and 30*d* regulated by the heat-medium flow-rate regulating devices 36*a*, 36*b*, 36*c*, and 36*d*. For example, by adjusting the opening degrees of the heat-medium flow-rate regulating devices 36*a*, 36*b*, 36*c*, and 36*d* so that the heat-medium temperature difference between the inlets and the outlets of the use-side heat exchangers 30*a*, 30*b*, 30*c*, and 30*d* becomes constant, the flow rates of the heat mediums flowing into the use-side heat exchangers 30*a*, 30*b*, 30*c*, and 30*d* can be regulated even if the sizes or loads of the use-side heat exchangers 30*a*, 30*b*, 30*c*, and 30*d* are different from each other. If any one of the indoor units 2 is to be stopped, the heat-medium flow-rate regulating valve 36 will be fully closed.

The heat mediums having flowed out of the use-side heat exchangers 30*a*, 30*b*, 30*c*, and 30*d* pass through the heat-medium channel switching devices 35*a*, 35*b*, 35*c*, and 35*d*. At this time, the heat-medium channel switching devices 35*a* and 35*b* are configured such that the heat medium flowing out to a first heat-medium channel 62*a* pass through them. Also, the heat-medium channel switching devices 35*c* and 35*d* are configured such that the heat medium flowing out to a second heat-medium channel 62*b* passes through them.

(Heating Only Operation)

First, the flow of the refrigerant in the refrigerating cycle circuit will be described. In the heat source unit 1, the refrigerant sucked into the compressor 10 is compressed and discharged as a high-pressure gas refrigerant. The refrigerant coming out of the compressor 10 flows through the four-way valve 11 and further flows into the heat-medium converter 3 through the refrigerant pipeline 4.

The gas refrigerant having flowed into the heat-medium converter 3 flows into the inter-heat-medium heat exchanger 14*b*. Since the inter-heat-medium heat exchanger 14*b* functions as a condenser for the refrigerant, the refrigerant passing through the inter-heat-medium heat exchanger 14*b* heats the heat medium, which is the target of the heat exchange (radiates heat to the heat medium). In the inter-heat-medium heat exchanger 14*b*, the refrigerant is not fully liquefied but flows out as a gas-liquid two-phase refrigerant.

The high temperature and high pressure gas-liquid two-phase refrigerant further flows into the inter-heat-medium heat exchanger 14*a*. At this time, the expansion device 15*b* is kept fully open so as not to cause pressure loss. As described above, the gas-liquid two-phase refrigerant heats the heat medium, becomes a liquid refrigerant in the inter-heat-medium heat exchanger 14*a* and flows out. The liquid refrigerant having flowed out is decompressed by the expansion device 15*a* and becomes a low temperature and low pressure gas-liquid two-phase refrigerant. The low temperature and low pressure refrigerant passes through the refrigerant pipeline 4 and flows out of the heat-medium converter 3.

The refrigerant having flowed into the heat source unit 1 flows into the heat-source-side heat exchanger 12 and is evaporated by heat exchange with air and flows out as a gas refrigerant or gas-liquid two-phase refrigerant. The evaporated refrigerant is sucked into the compressor 10 again through the four-way valve 11 and the accumulator 16.

Subsequently, the flow of the heat medium in the heat-medium circulation circuit will be described. The heat medium is heated by heat exchange with the refrigerant in the inter-heat-medium heat exchangers 14*a* and 14*b*. The heat medium having been heated in the inter-heat-medium heat exchanger 14*a* is sucked by the pump 31*a* and is fed out to the first heat-medium channel 61*a*. Also, the heat medium having been heated in the inter-heat-medium heat exchanger 14*b* is sucked by the pump 31*b* and is fed out to the second heat-medium channel 61*b*. The heat medium having been fed out to the first heat-medium channel 61*a* flows into one of the inlets of the auxiliary heat exchanger 32. The heat medium having been fed out to the second heat-medium channel 61*b* flows into the other inlet of the auxiliary heat exchanger 32. The detailed effects of the auxiliary heat exchanger 32 will be described later. At this time, the opening/closing device 33*a* is closed, while the opening/closing device 33*b* is opened.

The heat mediums in the first heat-medium channel 61*a* and the second heat-medium channel 61*b* have their channels switched by the heat-medium channel switching devices 34*a*, 34*b*, 34*c*, and 34*d* and flow into the use-side heat exchangers 30*a*, 30*b*, 30*c*, and 30*d*. Here, the channels of the heat-medium channel switching devices 34*a*, 34*b*, 34*c*, and 34*d* are configured such that the heat medium in the first heat-medium channel 61*a* flows into the use-side heat exchangers 30*a* and 30*b* and the heat medium in the second heat-medium channel 61*b* flows into the use-side heat exchangers 30*c* and 30*d*, for example. At this time, it is only necessary that the heating capacity obtained by totaling capacities of the indoor units 2*a* and 2*b* heated by the heat medium of the first heat-medium channel 61*a* and the heating capacity obtained by totaling capacities of the indoor units 2*c* and 2*d* heated by the heat medium of the second heat-medium channel 61*b* constitute approximately half. The heating capacity of the indoor units 2*a*, 2*b*, 2*c*, and 2*d* can be determined by the controller 50, for example. In the above case, the heat-medium channel switching devices 34*a* and 34*b* are configured such that the heat medium of the first heat-medium channel 61*a* passes through them. The heat-medium channel switching devices 34*c* and 34*d* are configured such that the heat medium of the second heat medium channel 61*b* passes through them.

The heat mediums having passed through the heat-medium channel switching devices 34*a*, 34*b*, 34*c*, and 34*d* have their flow rates flowing into the use-side heat exchangers 30*a*, 30*b*, 30*c*, and 30*d* regulated by the heat-medium flow-rate regulating devices 36*a*, 36*b*, 36*c*, and 36*d*. For example, by adjusting the opening degrees of the heat-medium flow-rate regulating devices 36*a*, 36*b*, 36*c*, and 36*d* so that the heat-medium temperature difference between the inlets and the outlets of the use-side heat exchangers 30*a*, 30*b*, 30*c*, and 30*d* becomes constant, the flow rates of the heat mediums flowing into the use-side heat exchangers 30*a*, 30*b*, 30*c*, and 30*d* can be regulated even if the sizes or loads of the use-side heat exchangers 30*a*, 30*b*, 30*c*, and 30*d* are different from each other. If any one of the indoor units 2 is to be stopped, the heat-medium flow-rate regulating valve 36 will be fully opened.

The heat mediums having flowed out of the use-side heat exchangers 30*a*, 30*b*, 30*c*, and 30*d* pass through the heat-medium channel switching devices 35*a*, 35*b*, 35*c*, and 35*d*. At this time, the heat-medium channel switching devices 35*a* and 35*b* are configured such that the heat medium flowing out to the first heat-medium channel 62*a* passes through them. Also, the heat-medium channel switching devices 35*c* and 35*d* are configured such that the heat medium flowing out to the second heat-medium channel 62*b* passes through them.

(Cooling-Main Operation)

First, the flow of the refrigerant in the refrigerating cycle circuit will be described. In the heat source unit 1, the refrigerant sucked into the compressor 10 is compressed and discharged as a high-pressure gas refrigerant. The refrigerant coming out of the compressor 10 flows into the heat-source-side heat exchanger 12 that functions as a condenser via the four-way valve 11. The high-pressure gas refrigerant is condensed by heat exchange with the outside air while passing through the heat-source-side heat exchanger 12, but the refrigerant is not fully liquefied but flows out as a high-pressure gas-liquid two-phase refrigerant and flows into the heat-medium converter 3 via the refrigerant pipeline 4.

The refrigerant having flowed into the heat-medium converter 3 flows into the inter-heat-medium heat exchanger 14*a*. At this time, the expansion device 15*a* is kept fully open so that pressure loss is not caused. Since the inter-heat-medium heat exchanger 14*a* functions as a condenser for the refrigerant, the refrigerant passing through the inter-heat-medium heat exchanger 14*a* heats and liquefies the heat medium (radiates heat to the heat medium), which is the target of the heat exchange.

The liquefied refrigerant is decompressed by the expansion device 15*b* and becomes a low temperature and low pressure gas-liquid two-phase refrigerant. The low temperature and low pressure refrigerant flows into the inter-heat-medium heat exchanger 14*b*. Since the inter-heat-medium heat exchanger 14*b* functions as an evaporator for the refrigerant, the refrigerant passing through the inter-heat-medium heat exchanger 14*b* cools and gasifies the heat medium (absorbs heat from the heat medium), which is the target of the heat exchange. The gas refrigerant having flowed out passes through the refrigerant pipeline 4 and flows out of the heat-medium converter 3.

The refrigerant having flowed into the heat source unit 1 is again sucked into the compressor 10 through the four-way valve 11 and the accumulator 16.

Subsequently, the flow of the heat medium in the heat-medium circulation circuit will be described. The heat medium is heated by heat exchange with the refrigerant in the inter-heat-medium heat exchanger 14*a*. The heat medium heated by the inter-heat-medium heat exchanger 14*a* is sucked by the pump 31*a* and fed out to the first heat-medium channel 61*a*. Also, in the inter-heat-medium heat exchanger 14*b*, the heat medium is cooled by heat exchange with the refrigerant. The heat medium heated by the inter-heat-medium heat exchanger 14*b* is sucked by the pump 31*b* and fed out to the second heat-medium channel 61*b*. At this time, the opening/closing device 33*b* is closed, and the opening/closing device 33*a* is opened so that the heated heat medium is made to bypass the auxiliary heat exchanger 32. As a result, heat exchange between the cooled heat medium and the heated heat medium is prevented.

The heat mediums in the first heat-medium channel 61*a* and the second heat-medium channel 61*b* have their channels switched by the heat-medium channel switching devices 34*a*, 34*b*, 34*c*, and 34*d* and flow into the use-side heat exchangers 30*a*, 30*b*, 30*c*, and 30*d*. Here, the channels of the heat-medium channel switching devices 34*a*, 34*b*, 34*c*, and 34*d* are configured such that the heat medium in the second heat-medium channel 61*b* passes through the heat-medium channel switching devices 34*a*, 34*b*, and 34*c* if the indoor units 2*a*, 2*b*, and 2*c* are performing a cooling operation and an indoor unit 2*d* is performing a heating operation and the cooled heat medium is made to flow into the use-side heat exchangers 30*a*, 30*b*, and 30*c*. Also, the heat medium in the first heat-medium channel 61*a* is made to pass through the heat-medium channel switching device 34*d* and the heated heat medium is made to flow into the use-side heat exchanger 30*d*. At this time, whether the indoor units 2*a*, 2*b*, 2*c*, and 2*d* are performing a cooling operation or a heating operation can be determined by the controller 50, for example, and the channels of the heat-medium channel switching devices 34*a*, 34*b*, 34*c*, and 34*d* are switched.

The heat mediums having passed through the heat-medium channel switching devices 34*a*, 34*b*, 34*c*, and 34*d* have their flow rates flowing into the use-side heat exchangers 30*a*, 30*b*, 30*c*, and 30*d* regulated by the heat-medium flow-rate regulating valves 36*a*, 36*b*, 36*c*, and 36*d*. For example, by adjusting the opening degrees of the heat-medium flow-rate regulating devices 36*a*, 36*b*, 36*c*, and 36*d* so that the heat-medium temperature difference between the inlets and the outlets of the use-side heat exchangers 30*a*, 30*b*, 30*c*, and 30*d* becomes constant, the flow rates of the heat mediums flowing into the use-side heat exchangers 30*a*, 30*b*, 30*c*, and 30*d* can be regulated even if the sizes or loads of the use-side heat exchangers 30*a*, 30*b*, 30*d*, and 30*d* are different from each other. If any one of the indoor units 2 is to be stopped, the heat-medium flow-rate regulating valve 36 will be fully opened.

The heat mediums having flowed out of the use-side heat exchangers 30*a*, 30*b*, 30*c*, and 30*d* pass through the heat-medium channel switching devices 35*a*, 35*b*, 35*c*, and 35*d*. At this time, the heat-medium channel switching devices 35*a*, 35*b*, and 35*c* are configured such that the heat medium flowing out to the second heat-medium channel 62*b* pass through them. Also, the heat-medium channel switching device 35*d* is configured such that the heat medium flowing out to the first heat-medium channel 62*a* passes through it.

(Heating-Main Operation)

First, the flow of the refrigerant in the refrigerating cycle circuit will be described. In the heat source unit 1, the refrigerant sucked into the compressor 10 is discharged as a high-pressure gas refrigerant. The refrigerant having flowed out of the compressor 10 flows through the four-way valve 11, further passes through the refrigerant pipeline 4 and flows into the heat-medium converter 3.

The gas refrigerant having flowed into the heat-medium converter 3 flows into the inter-heat-medium heat exchanger 14*b*. Since the inter-heat-medium heat exchanger 14*b* functions as a condenser for the refrigerant, the refrigerant passing through the inter-heat-medium heat exchanger 14*b* heats the heat medium, which is the target of the heat exchange, and is liquefied (radiates heat to the heat medium).

The high-pressure liquid refrigerant is made into a low temperature and low pressure gas-liquid two-phase refrigerant by the expansion device 15*b* and flows into the inter-heat-medium heat exchanger 14*a*. Since the inter-heat-medium heat exchanger 14*a* functions as an evaporator for the refrigerant, the refrigerant passing through the inter-heat-medium heat exchanger 14*a* cools the heat medium (absorbs heat from the heat medium), which is the target of the heat exchange, and flows out as a gas-liquid two-phase refrigerant. The gas-liquid two-phase refrigerant having flowed out passes through the refrigerant pipeline 4 and flows out of the heat-medium converter 3. At this time, the expansion device 15*a* is kept fully open so that pressure loss is not caused. The gas-liquid two-phase refrigerant having flowed out passes through the refrigerant pipeline 4 and flows out of the heat-medium converter 3.

The refrigerant having flowed into the heat source unit 1 flows into the heat-source-side heat exchanger 12 and is evaporated by heat exchange with the air and flows out as a gas refrigerant or a gas-liquid two-phase refrigerant. The evaporated refrigerant is again sucked into the compressor 10 through the four-way valve 11 and the accumulator 16.

Subsequently, the flow of the heat medium in the heat-medium circulation circuit will be described. The heat medium is cooled by heat exchange with the refrigerant in the inter-heat-medium heat exchanger 14*a*. The heat medium cooled by the inter-heat-medium heat exchanger 14*a* is sucked by the pump 31*a* and fed out to the first heat-medium channel 61*a*. Also, in the inter-heat-medium heat exchanger 14*b*, the heat medium is heated by heat exchange with the refrigerant. The heat medium heated by the inter-heat-medium heat exchanger 14*b* is sucked by the pump 31*b* and fed out to the second heat-medium channel 61*b*. At this time, the opening/closing device 33*b* is closed and the opening/closing device 33*a* is opened so that the heated heat medium is made to bypass the auxiliary heat exchanger 32. As a result, heat exchange between the cooled heat medium and the heated heat medium is prevented.

The heat mediums in the first heat-medium channel 61*a* and the second heat-medium channel 61*b* have their channels switched by the heat-medium channel switching devices 34*a*, 34*b*, 34*c*, and 34*d* and flow into the use-side heat exchangers 30*a*, 30*b*, 30*c*, and 30*d*. Here, the channels of the heat-medium channel switching devices 34*a*, 34*b*, 34*c*, and 34*d* are configured, for example, such that the heat medium in the second heat-medium channel 61*b* passes through the heat-medium channel switching devices 34*a*, 34*b*, and 34*c* if the indoor units 2*a*, 2*b*, and 2*c* are performing a heating operation and the indoor unit 2*d* is performing a cooling operation and the heated heat medium is made to flow into the use-side heat exchangers 30*a*, 30*b*, and 30*c*. Also, the heat medium in the first heat-medium channel 61*a* is made to pass through the heat-medium channel switching device 34*d* and the cooled heat medium is made to flow into the use-side heat exchanger 30*d*, At this time, whether the indoor units 2*a*, 2*b*, 2*c*, and 2*d* are performing a cooling operation or a heating operation can be determined by the controller 50, for example, and the channels of the heat-medium channel switching devices 34*a*, 34*b*, 34*c*, and 34*d* are switched.

The heat mediums having passed through the heat-medium channel switching devices 34*a*, 34*b*, 34*c*, and 34*d* have their flow rates flowing into the use-side heat exchangers 30*a*, 30*b*, 30*c*, and 30*d* regulated by the heat-medium flow-rate regulating devices 36*a*, 36*b*, 36*c*, and 36*d*. For example, by adjusting the opening degrees of the heat-medium flow-rate regulating devices 36*a*, 36*b*, 36*c*, and 36*d* so that the heat-medium temperature difference between the inlets and the outlets of the use-side heat exchangers 30*a*, 30*b*, 30*c*, and 30*d* becomes constant; the flow rates of the heat mediums flowing into the use-side heat exchangers 30*a*, 30*b*, 30*c*, and 30*d* can be regulated even if the sizes or loads of the use-side heat exchangers 30*a*, 30*b*, 30*c*, and 30*d* are different from each other. If any one of the indoor units 2 is to be stopped, the heat-medium flow-rate regulating valve 36 will be fully opened.

The heat mediums having flowed out of the use-side heat exchangers 30*a*, 30*b*, 30*c*, and 30*d* pass through the heat-medium channel switching devices 35*a*, 35*b*, 35*c*, and 35*d*. At this time, the heat-medium channel switching devices 35*a*, 35*b*, and 35*c* are configured such that the heat medium flowing out to the second heat-medium channel 62*b* pass through them. Also, the heat-medium channel switching device 35*d* is configured such that the heat medium flowing out to the first heat-medium channel 62*a* passes through it.

<Heat Medium Temperature Equalizing Method>

Subsequently a method of substantially equalizing the inlet heat-medium temperature of the use-side heat exchanger 30 when the heating only operation and the cooling only operation are performed will be described.

As described above, the refrigerating cycle device according to Embodiment 1 can increase a heat radiation amount from the refrigerant to the heat medium by increasing a heat transfer area between the refrigerant and the heat medium by using both the inter-heat-medium heat exchangers 14*a* and 14*b* during the heating only operation as condensers. However, the high temperature refrigerant gas discharged from the compressor 10 is condensed to some degree in the inter-heat-medium heat exchanger 14*b* and then, flows into the inter-heat-medium heat exchanger 14*a* again. An exchanged heat amount and temperature changes of the refrigerant and the heat medium are shown in FIG. 7.

Figure 7:
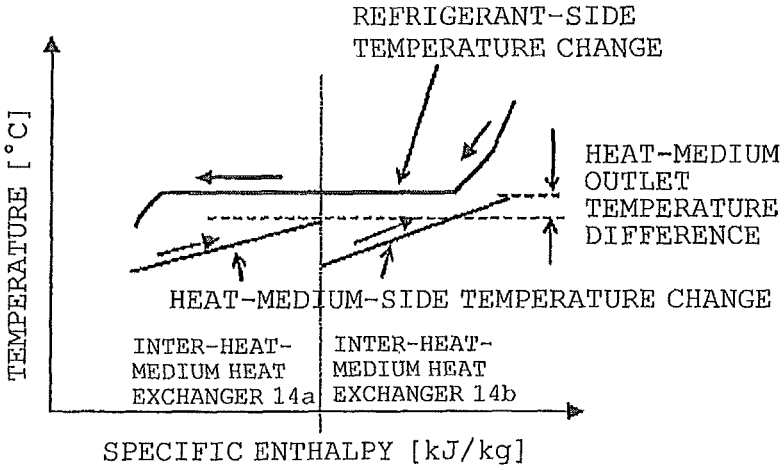
FIG. 7 is a diagram illustrating temperature changes of a refrigerant and a heat medium if the heat medium is heated by inter-heat-medium heat exchangers 14*a* and 14*b* according to Embodiment 1.

In FIG. 7, in the inter-heat-medium heat exchangers 14*a* and 14*b*, the temperature change on the refrigerant side and the temperature change of the heat medium are shown. Here, it is assumed that the heat-medium inlet temperatures are substantially equal.

At this time, the refrigerant inlet temperature of the inter-heat-medium heat exchanger 14*b* is approximately 80° C., for example, since the refrigerant is a discharge gas of the compressor 10. Thus, the outlet temperature of the heat medium can be raised to approximately a condensation temperature or above in the inter-heat-medium heat exchanger 14*b*. On the other hand, the refrigerant inlet temperature of the inter-heat-medium heat exchanger 14*a* is the condensation temperature and is approximately 50° C., for example. Thus, the heat-medium outlet temperature of the inter-heat-medium heat exchanger 14*a* might become lower than the heat-medium outlet temperature of the inter-heat-medium heat exchanger 14*b* as in FIG. 7.

Figure 11:
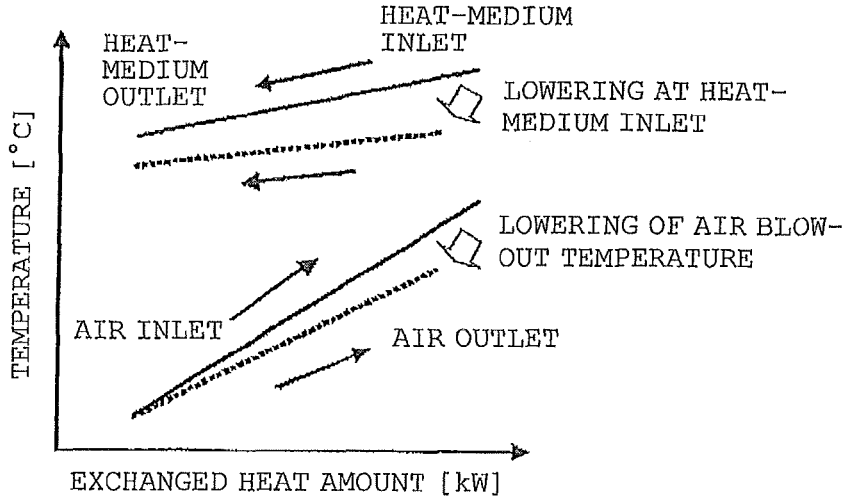
FIG. 11 is a diagram illustrating a change of an air blow-out temperature if a heat-medium inlet temperature is lowered in a use-side heat exchanger performing heating according to Embodiment 1.

For example, assume that the heat medium of the first heat-medium channel 61*a* having flowed out of the inter-heat-medium heat exchanger 14*a* flows into the use-side heat exchangers 30*a* and 30*b*, while the heat medium of the second heat-medium channel 61*b* having flowed out of the inter-heat-medium heat exchanger 14*b* flows into the use-side heat exchangers 30*c* and 30*d*. Then, the heat medium temperatures flowing into the use-side heat exchangers 30*a* and 30*b* become lower than those of the use-side heat exchangers 30*c* and 30*d*. As shown in FIG. 11, if the heat-medium inlet temperatures of the use-side heat exchangers 30*a* and 30*b* fall under a predetermined temperature, the exchanged heat amount between the heat medium and the air in the use-side heat exchangers 30*a* and 30*b* drop, the blow-out temperatures of the indoor units 2*a* and 2*b* become lower, and comfort of a user is lost. Also, assume that the velocity of the compressor 10 is increased, for example, in order to raise the temperatures of the heat mediums flowing into the use-side heat exchangers 30*a* and 30*b* to a predetermined temperature. Then, the temperatures of the heat mediums flowing into the use-side heat exchangers 30*c* and 30*d* become higher than the predetermined temperature and the heat medium is heated too much, thus energy cannot be saved.

Figure 8:
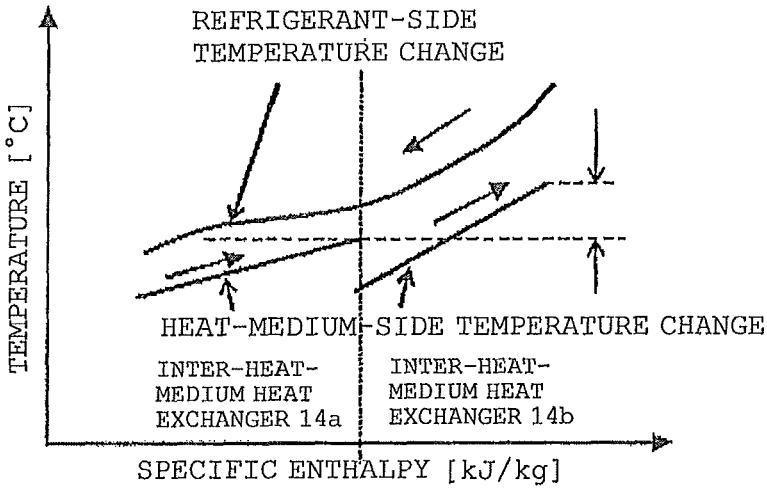
FIG. 8 is a diagram illustrating temperature changes of the refrigerant (supercritical cycle) and the heat medium if the heat medium is heated by the inter-heat-medium heat exchangers 14*a* and 14*b* according to Embodiment 1.

Also, the refrigerant such as carbon dioxide that might enter a supercritical state on the high pressure side does not have a condensation temperature as shown in FIG. 8 and continuously causes a temperature change. Thus, the difference between the heat-medium outlet temperature of the inter-heat-medium heat exchanger 14*a* and the heat-medium outlet temperature of the inter-heat-medium heat exchanger 14*b* described above becomes large.

Also, in the refrigerating cycle device according to Embodiment 1 as described above, both the inter-heat-medium heat exchangers 14*a* and 14*b* are both used as evaporators during the cooling only operation and an absorbed heat amount from the heat medium to the refrigerant can be made larger by increasing the heat transfer area between the refrigerant and the heat medium. The exchanged heat amount and the temperature changes of the refrigerant and the heat medium at this time are shown in FIG. 9.

Figure 9:
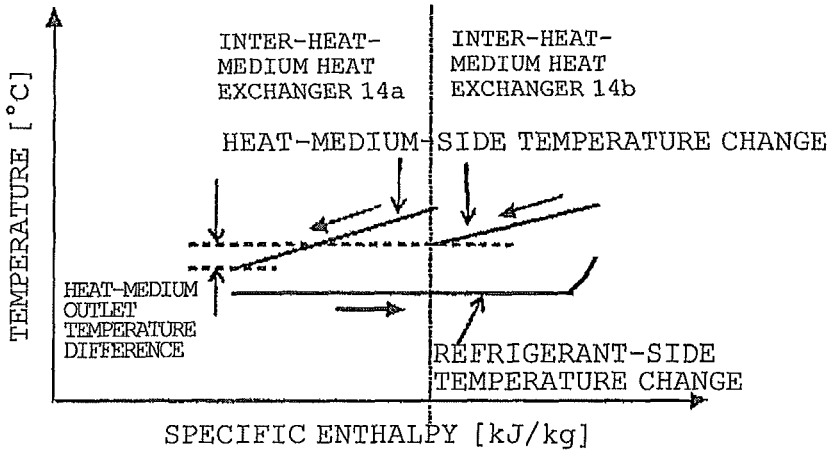
FIG. 9 is a diagram illustrating temperature changes of the refrigerant and the heat medium if the heat medium is cooled by the inter-heat-medium heat exchangers 14*a* and 14*b* according to Embodiment 1.

In FIG. 9, the temperature change on the refrigerant side and the temperature change of the heat medium in the inter-heat-medium heat exchangers 14*a* and 14*b* are shown. Here, it is assumed that the heat-medium inlet temperatures of the inter-heat-medium heat exchangers 14*a* and 14*b* are substantially equal.

At this time, the refrigerant outlet temperature of the inter-heat-medium heat exchanger 14*a* is an evaporation temperature and it is approximately 2° C., for example. On the other hand, the refrigerant outlet temperature of the inter-heat-medium heat exchanger 14*b* is a superheated gas and it is approximately 5° C., for example. With this superheated gas region, heat transfer performances are deteriorated, and further, the temperature difference between the heat medium and the refrigerant is reduced. As a result, the heat-medium outlet temperature of the inter-heat-medium heat exchanger 14*b* might become higher than the heat-medium outlet temperature of the inter-heat-medium heat exchanger 14*a* as shown in FIG. 9.

Figure 12:
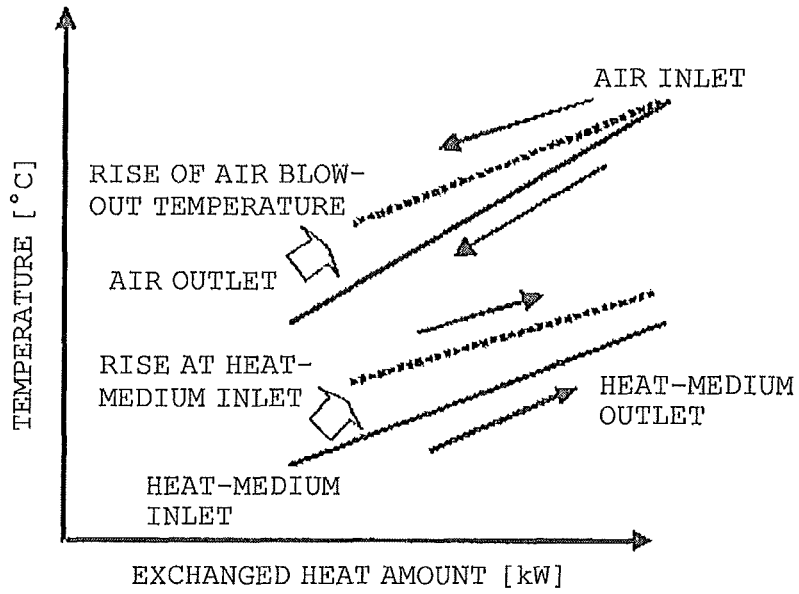
FIG. 12 is a diagram illustrating a change of the air blow-out temperature if the heat-medium inlet temperature is raised in a use-side heat exchanger performing cooling according to Embodiment 1.

Assume that the heat medium of the first heat-medium channel 61*a* having flowed out of the inter-heat-medium heat exchanger 14*a* flows into the use-side heat exchangers 30*a* and 30*b*, while the heat medium of the second heat-medium channel 61*b* having flowed out of the inter-heat-medium heat exchanger 14*b* flows into the use-side heat exchangers 30*c* and 30*d*. Then, the temperatures of the heat-mediums flowing into the use-side heat exchangers 30*c* and 30*d* become higher than those of the use-side heat exchangers 30*a* and 30*b*. As shown in FIG. 12, if the heat-medium inlet temperatures of the use-side heat exchangers 30*c* and 30*d* are raised higher than a predetermined temperature, the exchanged heat amount between the heat medium and the air drop in the use-side heat exchangers 30*c* and 30*d*, the blown-out temperature of the indoor units 2*a* and 2*b* becomes high, and comfort of a user is lost. Also, assume that the velocity of the compressor 10 is increased, for example, in order to lower the temperatures of the heat mediums flowing into the use-side heat exchangers 30*c* and 30*d* to a predetermined temperature. Then, the temperatures of the heat mediums flowing into the use-side heat exchangers 30*a* and 30*b* become lower than the predetermined temperature and the heat medium is cooled too much, thus energy cannot be saved.

Thus, in the refrigerating cycle device according to Embodiment 1, the heat-medium inlet temperatures of the use-side heat exchangers 30*a*, 30*b*, 30*c*, and 30*d* are made substantially equal by the following method. Specifically, the auxiliary exchanger 32 is provided, one inlet is connected to a discharge port of the pump 31*a* by a pipeline, while the other inlet is connected to a discharge port of the pump 31*b* by a pipeline so that when the use-side heat exchangers 30*a*, 30*b*, 30*c*, and 30*d* are performing the heating only operation or the cooling only operation, the heat mediums flowing through the first heat-medium channel 61*a* and the second heat-medium channel 61*b* perform heat exchange and the heat-medium inlet temperatures of the use-side heat exchangers 30*a*, 30*b*, 30*c*, and 30*d* are made substantially equal.

First, during the heating-main operation and the cooling-main operation, the opening/closing device 33*b* is closed, and the opening/closing device 33*a* is opened so that the heat medium of the first heat-medium channel 61*a* flows through a heat-medium bypass pipeline 40. As a result, the auxiliary heat exchanger 32 is bypassed.

Subsequently, during the heating only operation and the cooling only operation, the opening/closing device 33*b* is opened, and the opening/closing device 33*a* is closed so that the heat medium of the first heat-medium channel 61*a* is made to flow through the auxiliary heat exchanger 32. As a result, heat exchange is performed with the heat medium of the second heat-medium channel 61*b*.

As described above, since the heat medium discharged from the pump 31*a* and the heat medium discharged from the pump 31*b* are made to perform heat exchange, the heat-medium temperatures of the first heat-medium channel 61*a* and the second heat-medium channel 61*b* after flowing out of the auxiliary heat exchanger 32 become substantially equal. Here, assume that the heat medium of the first heat-medium channel 61*a* flows into the use-side heat exchangers 30*a* and 30*b* and the heat medium of the second heat-medium channel 61*b* flows into the use-side heat exchangers 30*c* and 30*d*, for example.

The heat medium flowing through the first heat-medium channel 61*a* passes through the heat-medium channel switching devices 34*a* and 34*b*, has the heat-medium flow rates regulated by the heat-medium flow-rate regulating devices 36*a* and 36*b* and flows into the use-side heat exchangers 30*a* and 30*b*. Also, the heat medium flowing through the second heat-medium channel 61*b* passes through the heat-medium channel switching devices 34*c* and 34*d*, has the heat-medium flow rates regulated by the heat-medium flow-rate regulating devices 36*c* and 36*d* and flows into the use-side heat exchangers 30*c* and 30*d*.

Here, the heat medium is a fluid such as water and an anti-freezing fluid and temperature drop is scarce even if the heat medium is decompressed by the heat-medium flow-rate regulating devices 36*a*, 36*b*, 36*c*, and 36*d*. Thus, the heat-medium inlet temperatures of the use-side heat exchangers 30*a*, 30*b*, 30*c*, and 30*d* can be made substantially equal.

Figure 2:
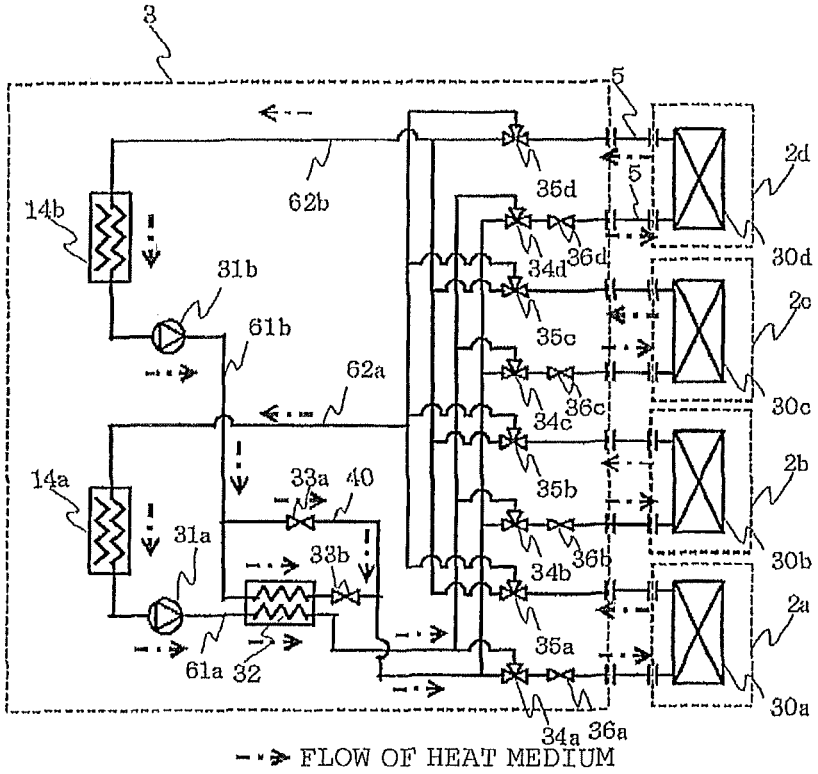
FIG. 2 is a diagram illustrating another form of a heat-medium side circuit according to Embodiment 1 of the present invention.

Also, in FIG. 1, the opening/closing devices 33*a* and 33*b* and the heat-medium bypass pipeline 40 are disposed in the first heat-medium channel 61*a*, and the effect will be the same when they are disposed in the second heat-medium channel 61*b* as shown in FIG. 2.

Also, in Embodiment 1, the heat-medium bypass pipeline 40 that bypasses the auxiliary heat exchanger 32 is disposed in either the first heat-medium channel 61*a* or the second heat-medium channel 61*b*. As a result, as compared with the case in which the heat-medium bypass pipeline 40 that bypasses the auxiliary heat exchanger 32 is disposed in both the first heat-medium channel 61*a* and the second heat-medium channel 61*b*, complication of the circuit due to increase in the number of heat-medium pipelines and opening/closing devices can be prevented.

As described above, even if the temperature difference in heat mediums flowing out of the inter-heat-medium heat exchangers 14*a* and 14*b* is large, by allowing the auxiliary heat exchanger 32 to perform heat exchange of the heat medium, the heat-medium inlet temperatures of the use-side heat exchangers 30*a*, 30*b*, 30*c*, and 30*d* can be made substantially equal. As a result, overheating or overcooling of the heat medium can be prevented, and an energy-saving refrigerating cycle device can be realized.

Figure 10:
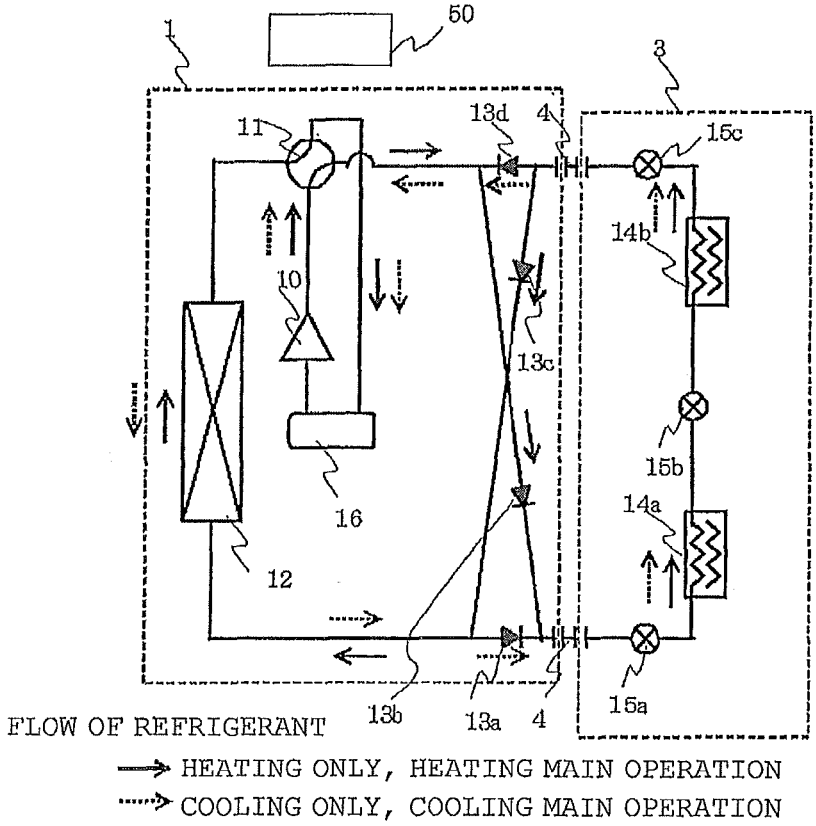
FIG. 10 is a diagram illustrating another form of a refrigerant-side circuit according to Embodiment 1 of the present invention.

Also, a refrigerant circuit diagram when check valves 13*a*, 13*b*, 13*c*, and 13*d* are disposed in the heat source unit 1 is shown in FIG. 10.

The check valves 13*a*, 13*b*, 13*c*, and 13*d* rectify the flow of the refrigerant by preventing backflow of the refrigerant and make the circulation path in inflow/outflow of the refrigerant in the heat source unit 1 constant. The inter-heat-medium heat exchanger 14*a* functions as an evaporator during the cooling only operation and allows the refrigerant to absorb heat so as to cool the heat medium. During the cooling-main operation, the heating-main operation, and the heating only operation, the heat exchanger 14*a* functions as a condenser and allows the refrigerant to radiate heat so as to heat the heat medium. The inter-heat-medium heat exchanger 14*b* functions as an evaporator during the cooling only operation, the cooling-main operation, and the heating-main operation. The heat exchanger 14*b* functions as a condenser during the heating only operation.

(Cooling Only Operation)

In the heat source unit 1, the refrigerant sucked into the compressor 10 is compressed and discharged as a high-pressure gas refrigerant. The refrigerant coming out of the compressor 10 flows into the heat-source-side heat exchanger 12 that functions as a condenser via the four-way valve 11. The high-pressure gas refrigerant is condensed by heat exchange with the outside air while passing through the heat-source-side heat exchanger 12, flows out as a high-pressure liquid refrigerant and flows through the check valve 13*a* (does not flow through the check valves 13*b* and 13*c* side due to the pressure of the refrigerant). Moreover, the refrigerant flows into the heat-medium converter 3 through the refrigerant pipeline 4.

The refrigerant having flowed into the heat-medium converter 3 is expanded by adjusting the opening degree of the expansion device 15*a*, and a low temperature and low pressure gas-liquid two-phase refrigerant flows into the inter-heat-medium heat exchanger 14*a*. Since the inter-heat-medium heat exchanger 14*a* functions as an evaporator for the refrigerant, the refrigerant passing through the inter-heat-medium heat exchanger 14*a* cools the heat medium, which is the target of the heat exchange (absorbs heat from the heat medium). In the inter-heat-medium heat exchanger 14*a*, the refrigerant is not fully vaporized but flows out, as it is, as the gas-liquid two-phase refrigerant. At this time, the expansion device 15*b* is kept fully open so that pressure loss is not caused.

The low temperature and low pressure gas-liquid two-phase refrigerant further flows into the inter-heat-medium heat exchanger 14*b*. As described above, the gas-liquid two-phase refrigerant cools the heat medium, becomes a gas refrigerant in the inter-heat-medium heat exchanger 14*b* and flows out. The gas refrigerant having flowed out passes through the refrigerant pipeline 4 and flows out of the heat-medium converter 3.

The refrigerant having flowed into the heat source unit 1 passes through the check valve 13*d* and is further sucked again into the compressor 10 via the four-way valve 11 and the accumulator 16.

(Heating Only Operation)

In the heat source unit 1, the refrigerant sucked into the compressor 10 is compressed and discharged as a high-pressure gas refrigerant. The refrigerant coming out of the compressor 10 flows through the four-way valve 11 and the check valve 13*b*. The refrigerant further flows into the heat-medium converter 3 through the refrigerant pipeline 4.

The gas refrigerant having flowed into the heat-medium converter 3 flows into the inter-heat-medium heat exchanger 14*a*. At this time, the expansion device 15*a* is kept fully open so as not to cause pressure loss. Since the inter-heat-medium heat exchanger 14*a* functions as a condenser for the refrigerant, the refrigerant passing through the inter-heat-medium heat exchanger 14*a* heats the heat medium(radiates heat to the heat medium), which is the target of the heat exchange. In the inter-heat-medium heat exchanger 14*a*, the refrigerant is not fully liquefied but flows out as the gas-liquid two-phase refrigerant.

The high temperature and high pressure gas-liquid two-phase refrigerant further flows into the inter-heat-medium heat exchanger 14*b*. At this time the expansion device 15*b* is kept fully open so as not to cause pressure loss. As described above, the gas-liquid two-phase refrigerant heats the heat medium, becomes a liquid refrigerant in the inter-heat-medium heat exchanger 14*b* and flows out. The liquid refrigerant having flowed out is decompressed by an expansion device 15*c* and becomes a low temperature and low pressure gas-liquid two-phase refrigerant. The low temperature and low pressure refrigerant passes through the refrigerant pipeline 4 and flows out of the heat-medium converter 3.

The refrigerant having flowed into the heat source unit 1 flows into the heat-source-side heat exchanger 12 that functions as an evaporator via the check valve 13*c* and is evaporated by heat exchange with air and flows out as a gas refrigerant or gas-liquid two-phase refrigerant. The evaporated refrigerant is sucked into the compressor 10 again through the four-way valve 11 and the accumulator 16.

(Cooling-Main Operation)

In the heat source unit 1, the refrigerant sucked into the compressor 10 is compressed and discharged as a high-pressure gas refrigerant. The refrigerant coming out of the compressor 10 flows into the heat-source-side heat exchanger 12 that functions as a condenser via the four-way valve 11. The high-pressure gas refrigerant is condensed by heat exchange with the outside air while passing through the heat-source-side heat exchanger 12. Here, during the cooling-main operation, it is configured such that the gas-liquid two-phase refrigerant flows out of the heat-source-side heat exchanger 12. The gas-liquid two-phase refrigerant having flowed out of the heat-source-side heat exchanger 12 flows through the check valve 13*a*. The refrigerant further flows into the heat-medium converter 3 via the refrigerant pipeline 4.

The refrigerant having flowed into the heat-medium converter 3 flows into the inter-heat-medium heat exchanger 14*a*. At this time, the expansion device 15*a* is kept fully open so that pressure loss is not caused. Since the inter-heat-medium heat exchanger 14*a* functions as a condenser for the refrigerant, the refrigerant passing through the inter-heat-medium heat exchanger 14*a* heats and liquefies the heat medium (radiates heat to the heat medium), which is the target of the heat exchange.

The liquefied refrigerant is decompressed by the expansion device 15*b* and becomes a low temperature and low pressure gas-liquid two-phase refrigerant. The low temperature and low pressure refrigerant flows into the inter-heat-medium heat exchanger 14*b*. Since the inter-heat-medium heat exchanger 14*b* functions as an evaporator for the refrigerant, the refrigerant passing through the inter-heat-medium heat exchanger 14*b* cools and gasifies the heat medium (absorbs heat from the heat medium), which is the target of the heat exchange. The gas refrigerant having flowed out passes through the refrigerant pipeline 4 and flows out of the heat-medium converter 3.

The refrigerant having flowed into the heat source unit 1 is again sucked into the compressor 10 through the four-way valve 11 and the accumulator 16.

(Heating-Main Operation)

In the heat source unit 1, the refrigerant sucked into the compressor 10 is compressed and discharged as a high-pressure gas refrigerant. The refrigerant having flowed out of the compressor 10 flows through the four-way valve 11 and the check valve 13*b*. The refrigerant further passes through the refrigerant pipeline 4 and flows into the heat-medium converter 3.

The gas refrigerant having flowed into the heat-medium converter 3 flows into the inter-heat-medium heat exchanger 14*a*. At this time, the expansion device 15*a* is kept fully open so as not to cause pressure loss. Since the inter-heat-medium heat exchanger 14*a* functions as a condenser for the refrigerant, the refrigerant passing through the inter-heat-medium heat exchanger 14*a* heats the heat medium, which is the target of the heat exchange, and is liquefied (radiates heat to the heat medium).

The high-pressure liquid refrigerant is made into a low temperature and low pressure gas-liquid two-phase refrigerant by the expansion device 15*b* and flows into the inter-heat-medium heat exchanger 14*b*. Since the inter-heat-medium heat exchanger 14*b* functions as an evaporator for the refrigerant, the refrigerant passing through the inter-heat-medium heat exchanger 14*b* cools the heat medium (absorbs heat from the heat medium), which is the target of the heat exchange, and flows out as a gas-liquid two-phase refrigerant. The gas-liquid two-phase refrigerant having flowed out passes through the refrigerant pipeline 4 and flows out of the heat-medium converter 3.

The refrigerant having flowed into the heat source unit 1 flows into the heat-source-side heat exchanger 12 that functions as an evaporator via the check valve 13*c* and is evaporated by heat exchange with the air and flows out as a gas refrigerant or a gas-liquid two-phase refrigerant. The evaporated refrigerant is again sucked into the compressor 10 through the four-way valve 11 and the accumulator 16.

As shown in FIG. 10, since the direction in which the refrigerant flows in the heat-medium converter 3 is the same in all the operation conditions, the inter-heat-medium heat exchanger 14*a* constantly functions as a condenser and the inter-heat-medium heat exchanger 14*b* constantly functions as an evaporator while in the cooling/heating simultaneous operation. Thus, though the flows of the refrigerant are different in the heat source unit 1 between the heating-main operation and the cooling-main operation, the flow of the refrigerant does not change in the heat-medium converter 3.

In the above-described refrigerant circuit, even if the operation is switched from the heating-main operation, in which the use-side heat exchangers 30*a*, 30*b*, and 30*c* perform a heating operation and the use-side heat exchanger 30*d* performs a cooling operation, to the cooling-main operation, in which the use-side heat exchangers 30*b*, 30*c*, and 30*d* perform a cooling operation and the use-side heat exchanger 30*a* performs a heating operation, for example, the condenser and the evaporator are not switched. Thus, the warm heat medium for heating always flows through the first heat-medium channel 61*a* and the cool heat medium for cooling always flows through the second heat-medium channel 61*b*, and thus, the heating-main operation and the cooling-main operation can be switched to one other without stopping the flow of the heat medium.

Embodiment 2

Figure 3:
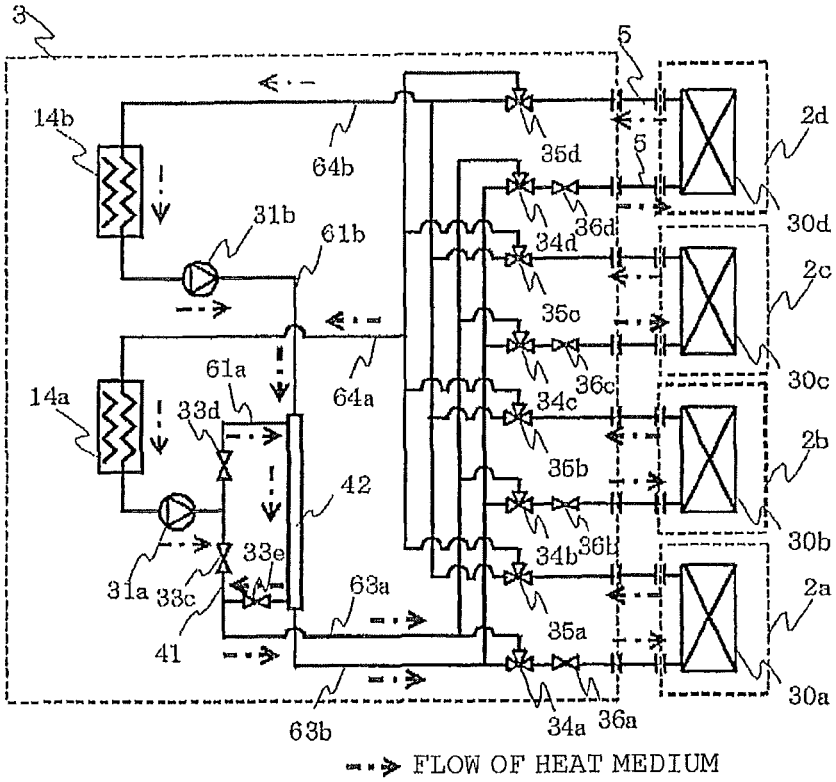
FIG. 3 is a heat-medium-side circuit diagram according to Embodiment 2 of the present invention.

In the above-described Embodiment 1, the heat mediums having flowed out of the two inter-heat-medium heat exchangers are made to perform heat exchange, but Embodiment 2 in which the heat mediums are directly brought into contact with each other will be illustrated below. FIG. 3 is a circuit diagram on the heat medium side of this case.

Specifically, a mixer 42 is provided, and one of inlets is connected to the discharge port of the pump 31*a* by a pipeline, while the other inlet is connected to a discharge port of the pump 31*b* by a pipeline so that when the use-side heat exchangers 30*a*, 30*b*, 30*c*, and 30*d* are performing the heating only operation or the cooling only operation, the heat mediums flowing through the first heat-medium channel 61*a* and the second heat-medium channel 61*b* are mixed and the heat-medium inlet temperatures of the use-side heat exchangers 30*a*, 30*b*, 30*c*, and 30*d* are made substantially equal.

First, during the heating-main operation and the cooling-main operation, opening/closing devices 33*d* and 33*e* are closed, and an opening/closing device 33*c* is opened so that the heat medium of the first heat-medium channel 61*a* flows through a heat-medium bypass pipeline 41. As a result, the mixer 42 is bypassed.

Subsequently, during the heating only operation, the opening/closing devices 33*d* and 33*e* are opened, and the opening/closing device 33*c* is closed. Then, the heat medium discharged from the pump 31*a* flowing through the first heat-medium channel 61*a* flows into the mixer 42. Also, the heat medium of the second heat-medium channel 61*b* discharged from the pump 31*b* constantly flows into the mixer 42. As a result, the heat mediums of the first heat-medium channel 61*a* and the second heat-medium channel 61*b* are mixed in the mixer 42.

The heat mediums which have been mixed and whose temperatures have been made equal pass through the opening/closing device 33*e* from one of the outlets of the mixer and flow into a first heat-medium channel 63*a*. The heat medium having flowed out of the other outlet flows into a second heat-medium channel 63*b*. At this time, the temperatures and the pressures of the heat mediums in the first heat-medium channel 63*a* and the second heat-medium channel 63*b* are substantially equal.

The heat medium of the first heat-medium channel 63*a* and the heat medium of the second heat-medium channel 63*b* have their channels switched by the heat-medium channel switching devices 34*a*, 34*b*, 34*c*, and 34*d* and flow into the use-side heat exchangers 30*a*, 30*b*, 30*c*, and 30*d*. Here, the channels of the heat-medium channel switching devices 34*a*, 34*b*, 34*c*, and 34*d* are configured such that the heat medium of the first heat-medium channel 61*a* flows into the use-side heat exchangers 30*a* and 30*b* and the heat medium of the second heat-medium channel 61*b* flows into the use-side heat exchangers 30*c* and 30*d*, for example. At this time, it is only necessary that the heating capacity obtained by totaling capacities of the indoor units 2*a* and 2*b* heated by the heat medium of the first heat-medium channel 63*a* and the heating capacity obtained by totaling capacities of the indoor units 2*c* and 2*d* heated by the heat medium of the second heat-medium channel 63*b* constitute approximately half. The heating capacity of the indoor units 2*a*, 2*b*, 2*c*, and 2*d* can be determined by the controller 50, for example. In the above case, the heat-medium channel switching devices 34*a* and 34*b* are configured such that the heat medium of the first heat-medium channel 63*a* passes through them. The heat-medium channel switching devices 34*c* and 34*d* are configured such that the heat medium of the second heat medium channel 63*b* passes through them.

The heat medium having passed through the heat-medium channel switching devices 34*a*, 34*b*, 34*c*, and 34*d* have their flow rates flowing into the use-side heat exchangers 30*a*, 30*b*, 30*c*, and 30*d* regulated by the heat-medium flow-rate regulating valves 36*a*, 36*b*, 36*c*, and 36*d*. For example, by adjusting the opening degrees of the heat-medium flow-rate regulating devices 36*a*, 36*b*, 36*c*, and 36*d* so that the heat-medium temperature difference between the inlets and the outlets of the use-side heat exchangers 30*a*, 30*b*, 30*c*, and 30*d* becomes constant, the flow rates of the heat mediums flowing into the use-side heat exchangers 30*a*, 30*b*, 30*c*, and 30*d* can be regulated even if the sizes or loads of the use-side heat exchangers 30*a*, 30*b*, 30*c*, and 30*d* are different from each other. If any one of the indoor units 2 is to be stopped, the heat-medium flow-rate regulating valve 36 will be fully closed.

The heat medium flowing through the first heat-medium channel 63*a* passes through the heat-medium channel switching devices 34*a* and 34*b*, has the heat-medium flow rates regulated by the heat-medium flow-rate regulating devices 36*a* and 36*b* and flows into the use-side heat exchangers 30*a* and 30*b*. Also, the heat medium flowing through the second heat-medium channel 63*b* passes through the heat-medium channel switching devices 34*c* and 34*d*, has the heat-medium flow rates regulated by the heat-medium flow-rate regulating devices 36*c* and 36*d* and flows into the use-side heat exchangers 30*c* and 30*d*.

Here, the heat medium is a fluid such as water and an anti-freezing fluid and the temperature drop is scarce even if the heat medium is decompressed by the heat-medium flow-rate regulating devices 36*a*, 36*b*, 36*c*, and 36*d*. Thus, the heat-medium inlet temperatures of the use-side heat exchangers 30*a*, 30*b*, 30*c*, and 30*d* can be made substantially equal.

The heat mediums having flowed out of the use-side heat exchangers 30*a*, 30*b*, 30*c*, and 30*d* pass through the heat-medium channel switching devices 35*a*, 35*b*, 35*c*, and 35*d*. At this time, the heat-medium channel switching devices 35*a* and 35*b* are configured such that the heat medium flowing out to a first heat-medium channel 64*a* passes through them. Also, the heat-medium channel switching devices 35*c* and 35*d* are configured such that the heat medium flowing out to a second heat-medium channel 64*b* passes through them.

Figure 4:
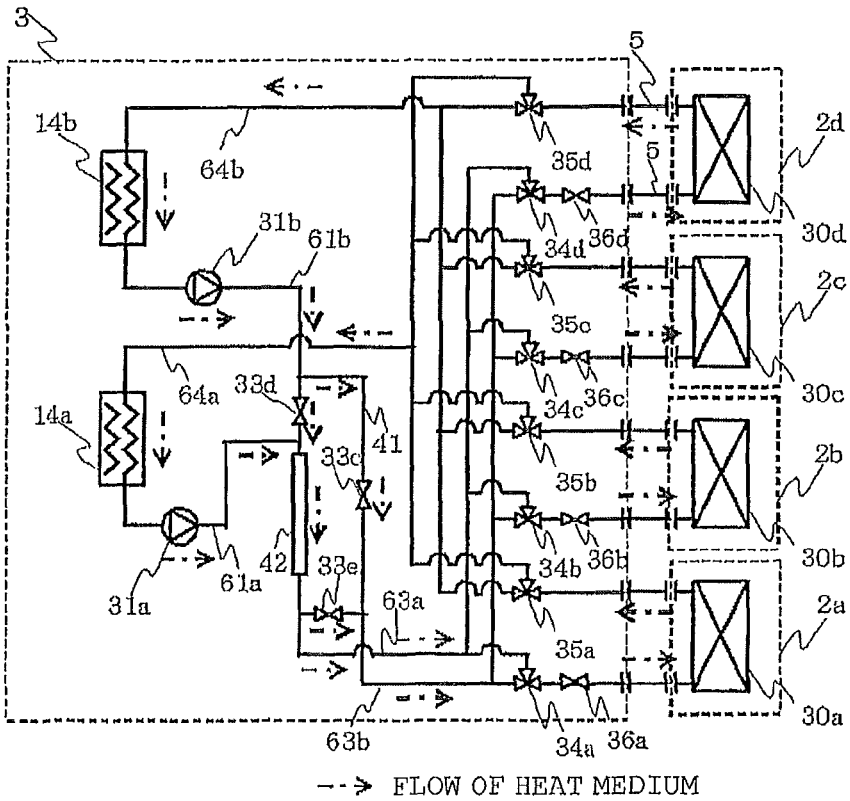
FIG. 4 is a diagram illustrating another form of a heat-medium side circuit according to Embodiment 2 of the present invention.

Also, in FIG. 3, the opening/closing devices 33*c*, 33*d*, and 33*e* and the heat-medium bypass pipeline 41 are disposed in the first heat-medium channel 61*a*, and the effect will be the same when they are disposed in the second heat-medium channel 61*b* as shown in FIG. 4.

Also, in Embodiment 2, the heat-medium bypass pipeline 40 that bypasses the mixer 42 is disposed in either the first heat-medium channel 61*a* or the second heat-medium channel 61*b*. As a result, as compared with the case in which the heat-medium bypass pipeline 40 that bypasses the mixer 42 is disposed in both of the first heat-medium channel 61*a* and the second heat-medium channel 61*b*, complication of the circuit due to increase in the number of heat-medium pipelines and opening/closing devices can be prevented.

As described above, even if the temperature difference in heat mediums flowing out of the inter-heat-medium heat exchangers 14*a* and 14*b* is large, by allowing the mixer 42 to perform heat exchange of the heat medium, the heat-medium inlet temperatures of the use-side heat exchangers 30*a*, 30*b*, 30*c*, and 30*d* can be made substantially equal. As a result, overheating or overcooling of the heat medium can be prevented, and an energy saving refrigerating cycle device can be realized.

Also, during the cooling only operation, too, the effect in which the heat-medium inlet temperatures of the use-side heat exchangers 30*a*, 30*b*, 30*c*, and 30*d* are made substantially equal can be obtained similarly to Embodiment 1.

Embodiment 3

Figure 5:
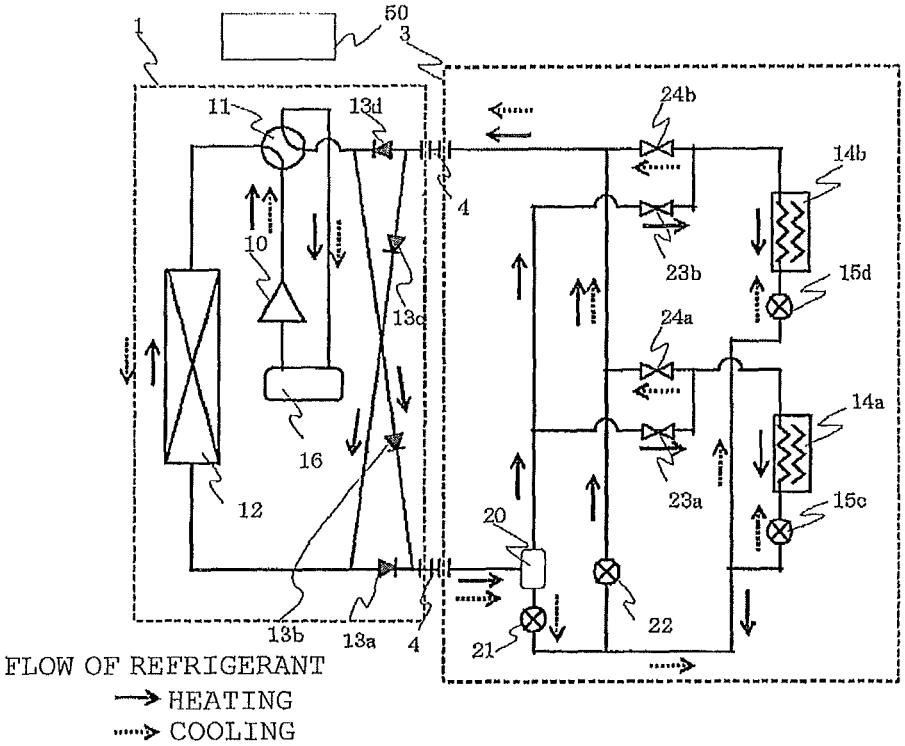
FIG. 5 is a refrigerant-side circuit diagram according to Embodiment 3 of the present invention.

In the above-described Embodiment 1, the inter-heat-medium heat exchangers are arranged so that the refrigerant flows in series on the heat source unit side, but Embodiment 3 in which the two inter-heat-medium heat exchangers are arranged so that the refrigerant flows in parallel during the heating only operation and the cooling only operation will be described below. FIG. 5 is a circuit diagram of the heat source side in this case.

In Embodiment 3, the compressor 10, the four-way valve 11, the heat-source-side heat exchanger 12, the check valves 13*a*, 13*b*, 13*c*, and 13*d* and the accumulator 16 are contained in the heat source unit 1 (outdoor unit). Also, the heat source unit 1 contains the controller 50 that supervises control of the entire refrigerating cycle device. The inter-heat-medium heat exchangers 14*a* and 14*b*, a gas-liquid separator 20, the expansion devices 15*c*, 15*d*, 21, and 22, and opening/closing devices 23*a*, 23*b*, 24*a*, and 24*b* are contained in the heat-medium converter 3.

The gas-liquid separator 20 separates the refrigerant flowing from the refrigerant pipeline 4 into a gasified refrigerant (gas refrigerant) and a liquefied refrigerant (liquid refrigerant). The opening/closing devices 23*a*, 23*b*, 24*a*, and 24*b* perform opening/closing of a valve in accordance with the operation mode according to cooling/heating and switch the channel of the refrigerant.

The inter-heat-medium heat exchanger 14*a* functions as an evaporator during the cooling only operation and has the refrigerant absorb heat so as to cool the heat medium. During the cooling-main operation, the heating-main operation, and the heating only operation, the heat exchanger 14*a* functions as a condenser and allows the refrigerant to radiate heat so as to heat the heat medium. The inter-heat-medium heat exchanger 14*b* functions as an evaporator during the cooling only operation, the cooling-main operation, and the heating-main operation. The heat exchanger 14*b* functions as a condenser during the heating only operation.

(Cooling Only Operation)

In the heat source unit 1, the refrigerant sucked into the compressor 10 is compressed and discharged as a high-pressure gas refrigerant. The refrigerant coming out of the compressor 10 flows into the heat-source-side heat exchanger 12 that functions as a condenser via the four-way valve 11. The high-pressure gas refrigerant is condensed in the heat-source-side heat exchanger 12 and flows out as a high-pressure liquid refrigerant. After that, the refrigerant flows through the check valve 13*a* and flows into the heat-medium converter 3 through the refrigerant pipeline 4.

The refrigerant having flowed into the heat-medium converter 3 passes through the gas-liquid separator 20. From the gas-liquid separator 20, only the liquid refrigerant flows out. During the cooling only operation, the opening/closing devices 23*a* and 23*b* are closed so that the refrigerant does not flow. Also, an expansion device 22 is set to such an opening degree that the refrigerant does not flow. The liquid refrigerant having passed through an expansion device 21 is decompressed while passing through the expansion devices 15*c* and 15*d*, becomes a low temperature and low pressure gas-liquid two-phase refrigerant and flows into the inter-heat-medium heat exchangers 14*a* and 14*b*. Since the inter-heat-medium heat exchangers 14*a* and 14*b* function as evaporators for the refrigerant, the refrigerant passing through the inter-heat-medium heat exchangers 14*a* and 14*b* cools the heat medium (absorbs heat from the heat medium), which is the target of the heat exchange, and flows out as a low pressure gas refrigerant. The gas refrigerant having flowed out passes through the opening/closing devices 24*a* and 24*b* and the refrigerant pipeline 4 and flows out of the heat-medium converter 3.

The refrigerant having flowed into the heat source unit 1 passes through the check valve 13*d* and is further sucked again into the compressor via the four-way valve 11 and the accumulator 16.

(Heating Only Operation)

In the heat source unit 1, the refrigerant sucked into the compressor 10 is compressed and discharged as a high-pressure gas refrigerant. The refrigerant coming out of the compressor 10 flows through the four-way valve 11 and the check valve 13*b*. The refrigerant further flows into the heat-medium converter 3 through the refrigerant pipeline 4.

The gas refrigerant having flowed into the heat-medium converter 3 passes through the gas-liquid separator 20. From the gas-liquid separator 20, only the gas refrigerant flows out. The gas refrigerant flows into the inter-heat-medium heat exchangers 14*a* and 14*b* through the opening/closing devices 23*a* and 23*b*. At this time, the opening/closing devices 24*a* and 24*b* are closed so that the refrigerant does not flow. Also, the expansion device 21 is set to such an opening degree that the refrigerant does not flow. Since the inter-heat-medium heat exchangers 14*a* and 14*b* function as condensers for the refrigerant, the refrigerant passing through the inter-heat-medium heat exchangers 14*a* and 14*b* heats the heat medium (radiates heat to the heat medium), which is the target of the heat exchange, and flows out as a liquid refrigerant.

The refrigerant having flowed out of the inter-heat-medium heat exchangers 14*a* and 14*b* passes through the expansion devices 15*c*, 15*d*, and 22 and flows out of the heat-medium converter 3 and flows into the heat source unit 1 via the refrigerant pipeline 4. At this time, the opening degrees of the expansion devices 15*c*, 15*d*, and 22 are controlled so as to regulate the flow rate of the refrigerant and to decompress the refrigerant, the low temperature and low pressure gas-liquid two-phase refrigerant flows out of the heat-medium coverer 3.

The refrigerant having flowed into the heat source unit 1 flows into the heat-source-side heat exchanger 12 via the check valve 13*c* and performs heat exchange with the air and is evaporated and flows out as a gas refrigerant or a gas-liquid two-phase refrigerant. The evaporated refrigerant is sucked into the compressor again via the four-way valve 11 and the accumulator 16.

(Cooling-Main Operation)

In the heat source unit 1, the refrigerant sucked into the compressor 10 is compressed and discharged as a high-pressure gas refrigerant. The refrigerant coming out of the compressor 10 flows into the heat-source-side heat exchanger 12 that functions as a condenser via the four-way valve 11. The high-pressure gas refrigerant is condensed by heat exchange with the outside air while passing through the heat-source-side heat exchanger 12. Here, during the cooling-main operation, it is configured such that the gas-liquid two-phase refrigerant flows out of the heat-source-side heat exchanger 12. The gas-liquid two-phase refrigerant having flowed out of the heat-source-side heat exchanger 12 flows through the check valve 13*a*. The refrigerant further flows into the heat-medium converter 3 via the refrigerant pipeline 4.

The gas-liquid two-phase refrigerant having flowed into the heat-medium converter 3 is separated into a gas refrigerant and a liquid refrigerant in the gas-liquid separator 20. The gas refrigerant separated in the gas-liquid separator 20 passes through the opening/closing device 23*a* and flows into the inter-heat-medium heat exchanger 14*a*. Since the inter-heat-medium heat exchanger 14*a* functions as a condenser for the refrigerant, the refrigerant passing through the inter-heat-medium heat exchanger 14*a* heats and liquefies the heat medium, which is the target of the heat exchange (radiates heat to the heat medium). The liquid refrigerant having flowed out of the inter-heat-medium heat exchanger 14*a* passes through the expansion device 15*c*. Here, the opening degree of the expansion device 15*c* is controlled so as to regulate the flow rate of the refrigerant passing through the inter-heat-medium heat exchanger 14*a*.

On the other hand, the liquid refrigerant separated in the gas-liquid separator 20 passes through the expansion device 21, merges with the liquid refrigerant passing through the expansion device 15*c*, passes through the expansion device 15*d* and flows into the inter-heat-medium heat exchanger 14*b*. Here, the opening degree of the expansion device 15*d* is controlled and the flow rate of the refrigerant is regulated so as to decompress the refrigerant, and thus, the low temperature and low pressure gas-liquid two-phase refrigerant flows into the inter-heat-medium heat exchanger 14*b*. Since the inter-heat-medium heat exchanger 14*b* functions as an evaporator for the refrigerant, the refrigerant passing through the inter-heat-medium heat exchanger 14*b* cools and gasifies the heat medium, which is the target of the heat exchange (absorbs heat from the heat medium). Here, the expansion device 21 is kept fully open. The opening degree of the expansion device 22 is set such that the refrigerant does not flow. Also, the opening/closing devices 24*a* and 23*b* are closed. The refrigerant having passed through the opening/closing device 24*b* passes through the refrigerant pipeline 4 and flows out of the heat-medium converter 3.

The refrigerant having flowed into the heat source unit 1 passes through the check valve 13*d* and is again sucked into the compressor through the four-way valve 11 and the accumulator 16.

(Heating-Main Operation)

In the heat source unit 1, the refrigerant sucked into the compressor 10 is compressed and discharged as a high-pressure gas refrigerant. The refrigerant having flowed out of the compressor 10 flows through the four-way valve 11 and the check valve 13*b*. The refrigerant further passes through the refrigerant pipeline 4 and flows into the heat-medium converter 3.

The refrigerant having flowed into the heat-medium converter 3 passes through the gas-liquid separator 20. The gas refrigerant having passed through the gas-liquid separator 20 passes through the opening/closing device 23*a* and flows into the inter-heat-medium heat exchanger 14*a*. Since the inter-heat-medium heat exchanger 14*a* functions as a condenser for the refrigerant, the refrigerant passing through the inter-heat-medium heat exchanger 14*a* heats and liquefies the heat medium, which is the target of the heat exchange (radiates heat to the heat medium). The liquid refrigerant having flowed out of the inter-heat-medium heat exchanger 14*a* passes through the expansion device 15*c*. Here, the opening degree of the expansion device 15*c* is controlled, and the flow rate of the refrigerant passing through the inter-heat-medium heat exchanger 14*a* is regulated. The expansion device 21 is set to such an opening degree that the refrigerant does not flow.

The refrigerant having passed through the expansion device 15*c* further passes through the expansion devices 15*d* and 22. The refrigerant having passed through the expansion device 15*d* flows into the inter-heat-medium heat exchanger 14*b*. Here, the opening degree of the expansion device 15*d* is controlled and the flow rate of the refrigerant is regulated so as to decompress the refrigerant, and thus, the low temperature and low pressure gas-liquid two-phase refrigerant flows into the inter-heat-medium heat exchanger 14*b*. Since the inter-heat-medium heat exchanger 14*b* functions as an evaporator for the refrigerant, the refrigerant passing through the inter-heat-medium heat exchanger 14*b* cools the heat medium, which is the target of the heat exchange, and becomes a gas refrigerant (absorbs heat from the heat medium) and flows out. The gas refrigerant having flowed out of the inter-heat-medium heat exchanger 14*b* passes through the opening/closing device 24*b*. On the other hand, the refrigerant having passed through the expansion device 22 also controls the opening degree of the expansion device 22 and thus, becomes a low temperature and low pressure gas-liquid two-phase refrigerant and merges with the gas refrigerant having passed through the opening/closing device 24*b*. Therefore, the refrigerant becomes a low temperature and low pressure refrigerant with higher dryness. The merged refrigerant passes through the refrigerant pipeline 4 and flows out of the heat-medium converter 3. Here, the opening/closing devices 23*b* and 24*a* are closed so that the refrigerant does not flow.

The refrigerant having flowed into the heat source unit 1 flows into the heat-source-side heat exchanger 12 and is evaporated by heat exchange with the air and flows out as a gas refrigerant or a gas-liquid two-phase refrigerant. The evaporated refrigerant is sucked into the compressor 10 again through the four-way valve 11 and the accumulator 16.

As described above, if the inter-heat-medium heat exchanger 14*a* and the inter-heat-medium heat exchanger 14*b* are arranged in parallel in a heat-source-side circuit, a high-temperature gas refrigerant flows into both the inter-heat-medium heat exchanger 14*a* and the inter-heat-medium heat exchanger 14*b* during the heating only operation. Thus, since the high-temperature gas refrigerant can perform heat exchange with the heat medium both in the inter-heat-medium heat exchanger 14*a* and the inter-heat-medium heat exchanger 14*b*, the heat-medium outlet temperatures of both the inter-heat-medium heat exchanger 14*a* and the inter-heat-medium heat exchanger 14*b* can be made high. Also, since the gas-liquid two-phase refrigerant with the same dryness can be made to flow into both the inter-heat-medium heat exchanger 14*a* and the inter-heat-medium heat exchanger 14*b* during the cooling only operation, the heat-medium outlet temperatures of both the inter-heat-medium heat exchanger 14*a* and the inter-heat-medium heat exchanger 14*b* can be made low. Also, since the refrigerant flow rates flowing into both the inter-heat-medium heat exchanger 14*a* and the inter-heat-medium heat exchanger 14*b* can be made substantially half of the total refrigerant flow rate flowing into the heat-medium converter 3 both in the heating only operation and the cooling only operation, pressure loss of the refrigerant can be reduced. Moreover, during the cooling/heating simultaneous operation, since the flow rates of the refrigerants flowing into the inter-heat-medium heat exchanger 14*a* and the inter-heat-medium heat exchanger 14*b* can be controlled separately, the heat amount radiated by the refrigerant into the heat medium in the inter-heat-medium heat exchanger 14*a* functioning as a condenser and the heat amount absorbed by the refrigerant from the heat medium in the inter-heat-medium heat exchanger 14*b* functioning as an evaporator can be easily controlled.

Here, the opening degrees of the expansion devices 15*c* and 15*d* are controlled so that the supercooling degrees of the refrigerant outlets of the inter-heat-medium heat exchanger 14*a* and the inter-heat-medium heat exchanger 14*b* are adjusted during the heating only operation and the superheating degrees of the refrigerant outlets of the inter-heat-medium heat exchanger 14*a* and the inter-heat-medium heat exchanger 14*b* are adjusted during the cooling only operation. At this time, when the differences in the temperatures and the flow rates of the heat mediums flowing into the inter-heat-medium heat exchangers 14*a* and 14*b* become large, the difference in the exchanged heat amount becomes large between the inter-heat-medium heat exchanger 14*a* and the inter-heat-medium heat exchanger 14*b*. As a result, the difference in the heat-medium outlet temperature of the inter-heat-medium heat exchanger 14*a* and the heat-medium outlet temperature of the inter-heat-medium heat exchanger 14*b* might become large.

Thus, as shown in Embodiment 1, by allowing the heat mediums flowing out of the two inter-heat-medium heat exchangers to be heat-exchanged with each other, the heat-medium outlet temperatures of the two inter-heat-medium heat exchangers can be substantially equalized. Alternatively, as shown in Embodiment 2, by bringing the heat mediums flowing out of the two inter-heat-medium heat exchangers into contact and mixing them, the heat-medium outlet temperatures of the two inter-heat-medium heat exchangers can be substantially equalized. As described above, the heat-medium inlet temperatures of the use-side heat exchangers 30*a*, 30*b*, 30*c*, and 30*d* can be substantially equalized.

Also, the refrigerant-side circuit of Embodiment 3 does not depend on the heat-medium-side circuit, and any of the heat-medium-side circuit shown in Embodiment 1 (FIGS. 1 and 2) and the heat-medium-side circuit shown in Embodiment 2 (FIGS. 3 and 4) can be combined.

Figure 6:
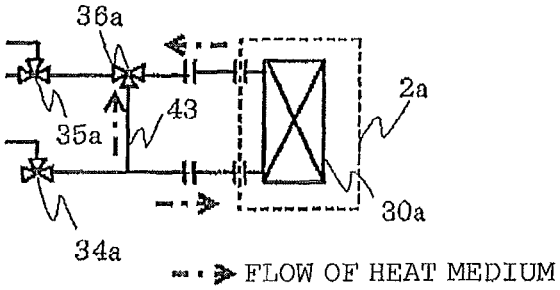
FIG. 6 is a diagram illustrating another form of a heat-medium flow-rate regulating device according to Embodiments 1 to 4.

Also, in the heat-medium-side circuits in Embodiments 1 to 3, the heat-medium flow rate flowing into each indoor unit 2 is regulated by the heat-medium flow-rate regulating devices 36*a*, 36*b*, 36*c*, and 36*d*. Instead of that, as shown in FIG. 6, a bypass pipeline 43 for the heat medium to bypass the use-side heat exchanger 30*a* may be disposed, and the heat-medium flow-rate regulating device 36*a*, which is a three-way valve, for example, may be installed at a heat-medium outlet of the bypass pipeline 43 and the use-side heat exchanger 30*a*. In this case, by regulating the flow rate of the heat medium flowing through the bypass pipeline 43, the heat-medium flow rate flowing into the use-side heat exchanger 30*a* can be regulated.

Also, in Embodiments 1 to 3, the heat source of the heat source unit is a refrigerating cycle circuit but various heat sources including a heater can be used.

Also, by substantially equalizing the heat-medium temperature, user comfort is improved by the following reasons. Here, assume that the use-side heat exchangers 30*a*, 30*b*, 30*c*, and 30*d* are performing a heating operation and the heat-medium inlet temperatures of the use-side heat exchangers 30*a* and 30*b* are lower than a predetermined temperature and the difference in the heat-medium inlet temperatures of the use-side heat exchangers 30*a*, 30*b*, 30*c*, and 30*d* is large.

As described above, load adjustment of the use-side heat exchanger 30 is performed by controlling the heat-medium flow-rate regulating device 36 so as to adjust the difference between the heat-medium inlet temperature and the outlet temperature of the use-side heat exchanger 30 by regulating the flow rate of the heat medium. However, if the heat-medium inlet temperatures (40° C., for example) of the use-side heat exchangers 30*a* and 30*b* are lower than the predetermined temperature (45° C., for example), the temperature difference between the heat medium and the air is made small in the use-side heat exchangers 30*a* and 30*b*. Thus, even if the opening degrees of the heat-medium flow-rate regulating devices 36*a* and 36*b* are fully open, the loads required by the indoor units 2*a* and 2*b* cannot be satisfied, and user comfort is lost.

On the other hand, in order to set the heat-medium inlet temperatures of the use-side heat exchangers 30*a* and 30*b* to a predetermined temperature, the output of the heat source unit needs to be raised by increasing the velocity of the compressor 10, for example. Then, in the use-side heat exchangers 30*c* and 30*d* whose heat-medium inlet temperatures are originally at the predetermined temperature or above, the heat-medium inlet temperatures are further raised (to 50° C., for example), the blow-out temperature of the indoor unit 2 can become too high even if the flow rate of the heat medium is decreased, whereby user comfort is lost. Also, the heat medium is heated to a temperature higher than necessary, which is not energy-saving. Due to the above reasons, the heat-medium inlet temperatures of the use-side heat exchangers need to be substantially equalized for comfortability.

For example, as a system, assume that the use-side heat exchangers 30*a*, 30*b*, 30*c*, and 30*d* are installed in each room. At this time, also assume that the refrigerating cycle device is performing a heating only operation. The flow rates of the heat mediums flowing into the use-side heat exchangers 30*a*, 30*b*, 30*c*, and 30*d* are regulated by the heat-medium flow-rate regulating valves 36*a*, 36*b*, 36*c*, and 36*d* in accordance with the loads of the indoor units 2*a*, 2*b*, 2*c*, and 2*d*. Here, by substantially equalizing the heat-medium inlet temperatures of the use-side heat exchangers 30*a*, 30*b*, 30*c*, and 30*d* to a predetermined temperature, even if the sizes of the use-side heat exchangers 30*a*, 30*b*, 30*c*, and 30*d* are different or a load in each room is different from each other, by controlling the opening degrees of the heat-medium flow-rate regulating devices 36*a*, 36*b*, 36*c*, and 36*d* and adjusting the temperature difference between the heat-medium inlet temperature and the outlet temperature of the use-side heat exchangers 30*a*, 30*b*, 30*c*, and 30*d*, the load adjustment of the indoor units 2*a*, 2*b*, 2*c*, and 2*d* can be made. As a result, user comfort can be obtained. Also, by substantially equalizing the heat-medium inlet temperatures of the use-side heat exchangers 30*a*, 30*b*, 30*c*, and 30*d*, the refrigerating cycle device can be operated at a heat-medium inlet temperatures of the use-side heat exchangers 30*a*, 30*b*, 30*c*, and 30*d* at which the COP is high, whereby energy can be saved.

Embodiment 4

Figure 13:
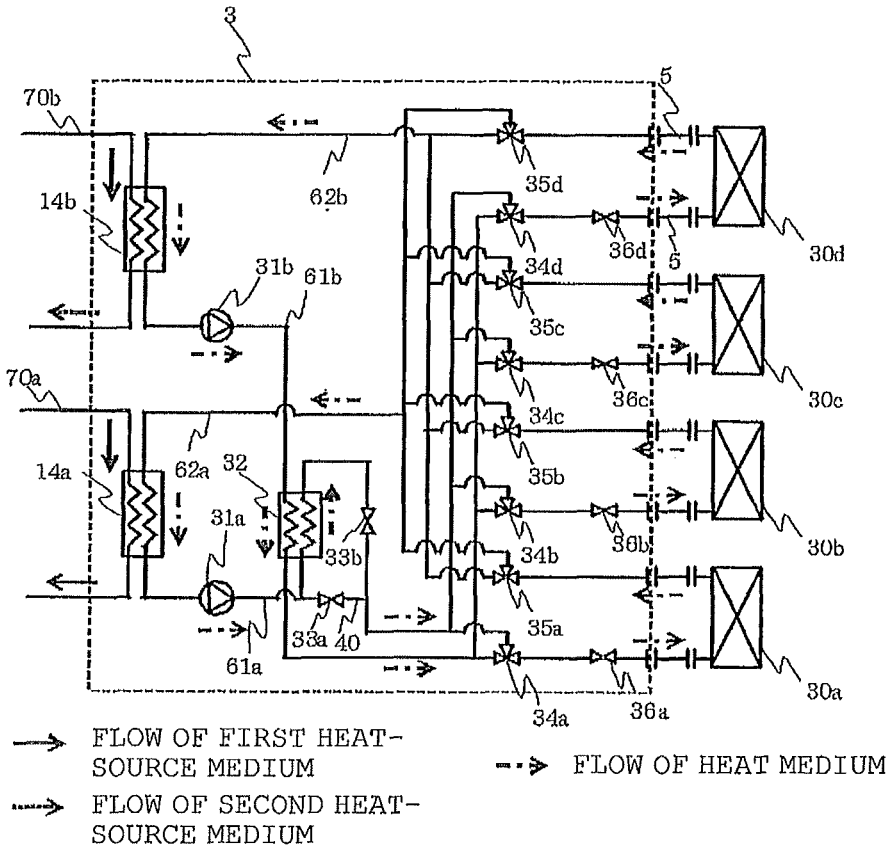
FIG. 13 is a heat-medium side circuit diagram of a refrigerating cycle device according to Embodiment 4.

FIG. 13 is a system circuit diagram of a refrigerating cycle device according to Embodiment 4 of the present invention. The refrigerating cycle device of Embodiment 4 is provided with a first heat-source medium pipeline 70*a* and a second heat-source medium pipeline 70*b*. Through the first heat-source medium pipeline 70*a*, a first heat-source medium flows. Through the second heat-source medium pipeline 70*b*, a second heat-source medium flows. Here, the first heat-source medium and the second heat-source medium may be the same or may be different. Also, the heat-source medium may be any type of medium such as water, brine, steam, a refrigerant and the like as long as it is fluid.

Also, the inter-heat-medium heat exchangers 14*a* and 14*b*, the use-side heat exchangers 30*a*, 30*b*, 30*c*, and 30*d*, the pumps 31*a* and 31*b*, which are heat-medium feeding devices, the heat-medium channel switching devices 34*a*, 34*b*, 34*c*, 34*d*, 35*a*, 35*b*, 35*c*, and 35*d*, and the heat-medium flow-rate regulating devices 36*a*, 36*b*, 36*c*, and 36*d* are connected by a pipeline so as to constitute a heat-medium circulation circuit. Here, the pump 31*a* corresponds to the first heat-medium feeding device. The pump 31*b* corresponds to the second heat-medium feeding device. The heat-medium channel switching devices 34*a*, 34*b*, 34*c*, and 34*d* correspond to the first heat-medium channel switching devices. The heat-medium channel switching devices 35*a*, 35*b*, 35*c*, and 35*d* correspond to the second heat-medium channel switching devices. The heat-medium flow-rate regulating devices 36*a*, 36*b*, 36*c*, and 36*d* correspond to the heat-medium flow-rate regulation unit. In Embodiment 4, the number of the use-side heat exchangers 30 is four, but the number of the use-side heat exchangers 30 is arbitrary.

Each of the use-side heat exchangers 30 has a heat transfer pipe through which the heat medium passes and a fin (not shown) that enlarges the heat transfer area between the heat medium flowing through the heat transfer pipe and the air and performs heat exchange between the heat medium and the air.

In Embodiment 4, the inter-heat-medium heat exchangers 14*a* and 14*b* are contained in the heat-medium converter 3 (branch unit), which is also a heat-medium branch unit. Also, the heat-medium channel switching devices 34*a*, 34*b*, 34*c*, 34*d*, 35*a*, 35*b*, 35*c*, and 35*d* and the heat-medium flow-rate regulating devices 36*a*, 36*b*, 36*c*, and 36*d* are also contained in the heat-medium converter 3.

Each of the heat-medium converter 3 and the use-side heat exchangers 30*a*, 30*b*, 30*c*, and 30*d* is connected to each other by the heat-medium pipeline 5 through which a safe heat medium such as water, an anti-freezing fluid and the like flows. That is, each of the heat-medium converter 3 and the use-side heat exchangers 30*a*, 30*b*, 30*c*, and 30*d* is connected by a single heat-medium path.

Each of the inter-heat-medium heat exchangers 14*a* and 14*b* has a heat transfer portion through which a heat-source medium passes and a heat transfer portion through which a heat medium passes and performs heat exchange between the heat mediums, that is, the heat-source medium and the heat medium. In Embodiment 4, in the inter-heat-medium heat exchanger 14*a*, the first heat-source medium heats or cools the heat medium. In the inter-heat-medium heat exchanger 14*b*, the second heat-source medium heats or cools the heat medium.

The auxiliary heat exchanger 32 has a heat transfer portion through which the heat medium passes and performs heat exchange between heat mediums flowing through the first heat-medium channel 61*a* and the second heat-medium channel 61*b*. One inlet is connected to the outlet of the pump 31*a* by a pipeline, and the other inlet is connected to the outlet of the pump 31*b* by a pipeline. In the channel on a first heat-medium pipeline 61*a* side, the heat-medium bypass pipeline 40 that has the auxiliary heat exchanger 32 bypassed and the opening/closing devices 33*a* and 33*b* are disposed.

For example, the first heat-source medium cools the heat medium in the inter-heat-medium heat exchanger 14*a*, the second heat-source medium cools the heat medium in the inter-heat-medium heat exchanger 14*b*, and the inlet temperature (5° C., for example) of the inter-heat-medium heat exchanger 14*b* of the second heat-source medium might be higher than the inlet temperature (2° C., for example) of the inter-heat-medium heat exchanger 14*a* of the first heat-source medium.

At this time, the heat-medium outlet temperature (10° C., for example) of the inter-heat-medium heat exchanger 14*b* becomes higher than the heat-medium outlet temperature (7° C., for example) of the inter-heat-medium heat exchanger 14*a*.

In Embodiment 4, in order to substantially equalize the heat-medium inlet temperatures of the use-side heat exchangers 30*a*, 30*b*, 30*c*, and 30*d*, the auxiliary heat exchanger 32 is provided. At this time, the opening/closing device 33*a* is closed, and the opening/closing device 33*b* is opened. Then, heat exchange is performed between heat mediums in the auxiliary heat exchanger 32, and if the flow rates of the heat mediums in the first heat-medium channels 61*a* and 61*b* are substantially the same, for example, the heat-medium outlet temperature of the auxiliary heat exchanger 33 becomes approximately an average value (8.5° C., for example) of the heat-medium outlet temperatures of the inter-heat-medium heat exchangers 14*a* and 14*b* both in the first heat-medium channels 61*a* and 61*b*.

The heat mediums in the first heat-medium channel 61*a* and the second heat-medium channel 61*b* have their channels switched by the heat-medium channel switching devices 34*a*, 34*b*, 34*c*, and 34*d* and flow into the use-side heat exchangers 30*a*, 30*b*, 30*c*, and 30*d*. Here, the channels of the heat-medium channel switching devices 34*a*, 34*b*, 34*c*, and 34*d* are configured such that the heat medium in the first heat-medium channel 61*a* flows into the use-side heat exchangers 30*a* and 30*b* and the heat medium in the second heat-medium channel 61*b* flows into the use-side heat exchangers 30*c* and 30*d*, for example. In the above case, the heat-medium channel switching devices 34*a* and 34*b* are configured such that the heat medium of the first heat-medium channel 61*a* passes through them. The heat-medium channel switching devices 34*c* and 34*d* are configured such that the heat medium of the first heat-medium channel 61*b* passes through them.

The heat medium having passed through the heat-medium channel switching devices 34*a*, 34*b*, 34*c*, and 34*d* have their flow rates flowing into the use-side heat exchangers 30*a*, 30*b*, 30*c*, and 30*d* regulated by the heat-medium flow-rate regulating devices 36*a*, 36*b*, 36*c*, and 36*d*. For example, by adjusting the opening degrees of the heat-medium flow-rate regulating devices 36*a*, 36*b*, 36*c*, and 36*d* so that the heat-medium temperature difference between the inlets and the outlets of the use-side heat exchangers 30*a*, 30*b*, 30*c*, and 30*d* becomes constant, the flow rates of the heat mediums flowing into the use-side heat exchangers 30*a*, 30*b*, 30*c*, and 30*d* can be regulated even if the sizes or loads of the use-side heat exchangers 30*a*, 30*b*, 30*c*, and 30*d* are different. If any of the use-side heat exchangers 30 is to be stopped, the heat-medium flow-rate regulating valve 36 will be fully opened.

The heat mediums having flowed out of the use-side heat exchangers 30*a*, 30*b*, 30*c*, and 30*d* pass through the heat-medium channel switching devices 35*a*, 35*b*, 35*c*, and 35*d*. At this time, the heat-medium channel switching devices 35*a* and 35*b* are configured such that the heat medium flowing out to the first heat-medium channel 62*a* passes through them. Also, the heat-medium channel switching devices 35*c* and 35*d* are configured such that the heat medium flowing out to the second heat-medium channel 62*b* passes through them.

As described above, the auxiliary heat exchanger 33 equalizes the heat medium temperatures of the first heat-medium channels 61*a* and 62*b*. Also, even if the flow rate of the heat medium is regulated in the heat-medium flow-rate regulating devices 36*a*, 36*b*, 36*c*, and 36*d*, a temperature change is rarely caused by decompression in water, an anti-freezing fluid or the like, the inlet temperatures of the use-side heat exchangers 30*a*, 30*b*, 30*c*, and 30*d* are substantially equalized.

As described above, since heat exchange is performed between the heat mediums in the auxiliary heat exchanger 32, even if the temperature difference is large between the heat-source mediums 70*a* and 70*b*, the heat-medium inlet temperatures of the use-side heat exchangers 30*a*, 30*b*, 30*c*, and 30*d* can be substantially equalized. Thus, it is useful when temperature control of the use-side heat exchanger 30 is required such as cold storage of foods and the like.

Industrial Applicability

As described above, the present invention is useful in a refrigerating cycle device using a heat medium such as water, an anti-freezing fluid and the like as a secondary medium and a refrigerating cycle device.

Reference Signs List

1 heat source unit (outdoor unit), 2*a*, 2*b*, 2*c*, 2*d* indoor unit, 3 heat-medium converter, 4 refrigerant pipeline, 5 heat-medium pipeline, 10 compressor, 11 four-way valve (refrigerant channel switching device), 12 heat-source-side heat exchanger, 13*a*, 13*b*, 13*c*, 13*d* check valve, 14*a*, 14*b* inter-heat-medium heat exchanger, 15*a*, 15*b*, 15*c*, 15*d* expansion device, 16 accumulator, 20 gas-liquid separator, 21, 22 expansion device, 23*a*, 23*b*, 24*a*, 24*b* opening/closing device, 30*a*, 30*b*, 30*c*, 30*d* use-side heat exchanger, 31*a*, 31*b* pump (heat-medium feeding device), 32 auxiliary heat exchanger, 33*a*, 33*b*, 33*c*, 33*d* opening/closing device, 34*a*, 34*b*, 34*c*, 34*d* heat-medium channel switching device, 35*a*, 35*b*, 35*c*, 35*d* heat-medium channel switching device, 36*a*, 36*b*, 36*c*, 36*d* heat-medium flow-rate regulating device, 40, 41 heat-medium bypass pipeline, 42 mixer, 43 heat-medium bypass pipeline, 50 controller, 61*a*, 62*a*, 63*a*, 64*a* first heat-medium channel, 61*b*, 62*b*, 63*b*, 64*b* second heat-medium channel, 70*a* first heat-source medium pipeline, 70*b* second heat-source medium pipeline

The invention claimed is:

1. A refrigerating cycle device comprising:

a plurality of use-side heat exchangers;

a first inter-heat-medium heat exchanger having one port connected to each heat-medium inlet of the use-side heat exchangers by a pipeline and the other port connected to each heat-medium outlet of the use-side heat exchangers;

a second inter-heat-medium heat exchanger having one port connected to each heat-medium inlet of the use-side heat exchangers by a pipeline and the other port connected to each heat-medium outlet of the use-side heat exchangers;

a plurality of first heat-medium channel switching devices, each of which is disposed on the heat-medium inflow side of each of the use-side heat exchangers, switching between a first inflow-side channel, which connects the first inter-heat-medium heat exchanger and the heat-medium inlets of the use-side heat exchangers, and a second inflow-side channel, which connects the second inter-heat-medium heat exchanger and the heat-medium inlets of the use-side heat exchangers;

a plurality of second heat-medium channel switching devices, each of which is disposed on the heat-medium outflow side of each of the use-side heat exchangers, switching between a first outflow-side channel, which connects the first inter-heat-medium heat exchanger and the heat-medium outlets of the use-side heat exchangers, and a second outflow-side channel, which connects the second inter-heat-medium heat exchanger and the heat-medium outlets of the use-side heat exchangers;

a heat source device that is connected to the first inter-heat-medium heat exchanger and the second inter-heat-medium heat exchanger and supplies heating energy or cooling energy to the first inter-heat-medium heat exchanger and the second inter-heat-medium heat exchanger so as to heat or cool a first heat medium flowing from the first inter-heat-medium heat exchanger to the use-side heat exchangers and a second heat medium flowing from the second inter-heat-medium heat exchanger to the use-side heat exchangers;

an auxiliary heat exchanger having a first heat-medium inlet which is connected to the first inter-heat-medium heat exchanger by a pipeline and which the first heat medium flows into, a first heat-medium outlet which allows the first heat medium having flowed in from the first heat-medium inlet to flow out to the use-side heat exchangers through the plurality of first heat-medium channel switching devices, a second heat-medium inlet which is connected to the second inter-heat-medium heat exchanger by a pipeline and which the second heat medium flows into, and a second heat-medium outlet which allows the second heat medium having flowed in from the second heat-medium inlet to flow out to the use-side heat exchangers through a plurality of the first heat-medium channel switching devices, and performing heat between the first heat medium flowing from the first heat-medium inlet to the first heat-medium outlet and the second heat medium flowing from the second heat-medium inlet to the second heat-medium outlet through a heat transfer material or performing heat exchange by mixing the first heat medium flowing in from the first heat-medium inlet and the second heat medium flowing in from the second heat-medium inlet and allowing the mixture to flow out of the first heat-medium outlet and the second heat-medium outlet; and a heat-medium channel that connects a bypass pipeline that bypasses the auxiliary heat exchanger and an opening/closing valve disposed in the bypass pipeline to the heat-medium outlet of either the first inter-heat-medium heat exchanger or the second inter-heat-medium heat exchanger that the heat medium flows out from.

2. The refrigerating cycle device of claim 1, wherein the auxiliary heat exchanger directly brings the heat medium having flowed in from the first heat-medium inlet and the heat medium having flowed in from the second heat-medium inlet into contact with each other to mix.

3. The refrigerating cycle device of claim 1, the heat source device further comprising a refrigerating cycle circuit provided with a compressor, a heat-source-side heat exchanger, at least one expansion device that regulates a pressure of a refrigerant, a refrigerant-side channel of the first inter-heat-medium heat exchanger, and a refrigerant-side channel of the second inter-heat-medium heat exchanger, connected by a pipeline.

4. The refrigerating cycle device of claim 1, the heat source device further comprising the refrigerant outlet of the first inter-heat-medium heat exchanger and the refrigerant inlet of the second inter-heat-medium heat exchanger being connected so that the refrigerant-side channel of the first inter-heat-medium heat exchanger and the refrigerant-side channel of the second inter-heat-medium heat exchanger are arranged in series, and the expansion device being disposed in the refrigerant channel that connects the first inter-heat-medium heat exchanger and the second inter-heat-medium heat exchanger.

5. The refrigerating cycle device of claim 1, the heat source device further comprising, a heat source unit that contains the compressor and the heat-source-side heat exchanger, and a heat-medium converter that contains any one of the first inter-heat-medium heat exchanger, the second inter-heat-medium heat exchanger, and the auxiliary heat exchanger.

6. The refrigerating cycle device of claim 1, wherein the heat source device contains a refrigerant that forms a supercritical cycle such as carbon dioxide.

7. The refrigerating cycle device of claim 1, wherein the heat source device includes a first heat-source medium channel that is connected by a pipeline to the first inter-heat-medium heat exchanger, supplies a heat-source medium to the first heat-medium heat exchanger and heats or cools the heat medium flowing from the first inter-heat-medium heat exchanger to the use-side heat exchanger, and a second heat-source medium channel that is connected by a pipeline to the second inter-heat-medium heat exchanger, supplies a heat-source medium to the second heat-medium heat exchanger and heats or cools the heat medium flowing from the second inter-heat-medium heat exchanger to the use-side heat exchanger.

* * * * *